US010370855B2

(12) United States Patent
Gassman et al.

(10) Patent No.: US 10,370,855 B2
(45) Date of Patent: Aug. 6, 2019

(54) ROOF DECK INTAKE VENT

(71) Applicant: Owens Corning Intellectual Capital, LLC, Toledo, OH (US)

(72) Inventors: Paul E. Gassman, Newark, OH (US); Christopher C. Freidner, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1133 days.

(21) Appl. No.: 13/842,381

(22) Filed: Mar. 15, 2013

(65) Prior Publication Data

US 2014/0099877 A1 Apr. 10, 2014

Related U.S. Application Data

(63) Continuation-in-part of application No. 29/434,133, filed on Oct. 10, 2012, now Pat. No. Des. 710,985.

(51) Int. Cl.
*E04D 13/17* (2006.01)

(52) U.S. Cl.
CPC ..... *E04D 13/178* (2013.01)

(58) Field of Classification Search
CPC ..... F24F 7/02; E04D 1/30; E04D 2001/309; E04D 13/14; E04D 1/24; E04D 1/28; E04D 13/17; E04D 13/178; E04D 13/152; E04D 13/172; E04D 13/174; E04D 13/176
USPC ..... D23/373, 393; D25/141; 454/366, 250, 454/260; 52/199, 198, 748.1
See application file for complete search history.

(56) References Cited

U.S. PATENT DOCUMENTS

| | | | |
|---|---|---|---|
| 2,447,472 | A | 8/1948 | Donley |
| 2,518,550 | A | 8/1950 | Ives |
| 2,724,872 | A | 11/1955 | Herbes |
| 2,777,381 | A | 1/1957 | Noyes |
| 3,189,471 | A | 6/1965 | Thomas |

(Continued)

FOREIGN PATENT DOCUMENTS

| | | |
|---|---|---|
| DE | 3935600 | 3/1990 |
| GB | 428720 | 5/1935 |

(Continued)

OTHER PUBLICATIONS

Office action from U.S. Appl. No. 12/393,261 dated Aug. 16, 2013.

(Continued)

*Primary Examiner* — Steven B McAllister
*Assistant Examiner* — Ko-Wei Lin
(74) *Attorney, Agent, or Firm* — Calfee, Halter & Griswold LLP

(57) ABSTRACT

A roof deck intake vent is provided. The roof deck intake vent includes a first portion connected to a second portion. The first portion is further connected to an upper edge and the second portion further connected to a lower edge. Opposing first and second side walls are connected to the first and second portions. The opposing first and second side walls extend from the upper edge to the lower edge. The first and second side walls form an extension having a lower surface. The first portion, upper edge, and the extension cooperate to form an air intake, such that air entering the roof deck intake vent enters the vent through the lower surface of the extension when the vent is installed on an edge or eave of a roof.

30 Claims, 18 Drawing Sheets

(56) References Cited

U.S. PATENT DOCUMENTS

D203,484 S 1/1966 Rousey et al.
3,484,259 A 12/1969 Lewis et al.
3,524,738 A 8/1970 Grubb et al.
3,535,096 A 10/1970 Bour et al.
3,625,134 A 12/1971 Smith
3,694,982 A 10/1972 Gerhaher
3,804,646 A 4/1974 Dumbaugh, Jr.
3,861,926 A 1/1975 Irlam et al.
3,887,386 A 6/1975 Majumdar
3,892,581 A 7/1975 Burgman et al.
3,904,423 A 9/1975 Guthrie
4,063,001 A 12/1977 Zlochower
4,199,364 A 4/1980 Neely
D256,047 S 7/1980 Wormington
4,212,692 A 7/1980 Rasen et al.
4,252,590 A 2/1981 Rasen et al.
4,315,392 A 2/1982 Sylvest
4,325,290 A 4/1982 Wolfert
4,325,724 A 4/1982 Froberg
4,366,251 A 12/1982 Rapp
4,375,527 A 3/1983 Zahner
4,393,634 A 7/1983 McDermott et al.
RE31,599 E 6/1984 Rasen et al.
4,491,951 A 1/1985 Dunn
4,530,193 A 7/1985 Ochs
4,554,862 A 11/1985 Wolfert
4,582,748 A 4/1986 Eastes
4,607,566 A * 8/1986 Bottomore ..... E04D 13/152 454/260
4,643,080 A 2/1987 Trostle et al.
4,676,147 A 6/1987 Mankowski
4,689,258 A 8/1987 Siosberg et al.
4,762,053 A 8/1988 Wolfert
4,764,487 A 8/1988 Lewis
4,776,262 A 10/1988 Curran
4,803,813 A 2/1989 Fiterman
4,805,367 A 2/1989 Kleckner
4,807,409 A 2/1989 Sells
4,810,573 A 3/1989 Harriett
4,817,506 A 4/1989 Cashman
4,843,953 A 7/1989 Sells
4,852,517 A 8/1989 Smith et al.
4,857,485 A 8/1989 Brennan et al.
4,892,846 A 1/1990 Rogers et al.
4,903,445 A 2/1990 Mankowski
4,924,761 A 5/1990 MacLeod et al.
4,935,291 A 6/1990 Gunnick
4,942,699 A 7/1990 Spinelli
4,957,037 A * 9/1990 Tubbesing ..... F24F 7/02 454/366
4,976,587 A 12/1990 Johnston et al.
4,996,812 A 3/1991 Venable
5,009,149 A 4/1991 MacLeod et al.
5,022,203 A 6/1991 Boyd
5,052,286 A 10/1991 Tubbesing et al.
5,054,254 A 10/1991 Sells
5,054,377 A 10/1991 Mochel et al.
5,092,225 A 3/1992 Sells
5,094,041 A 3/1992 Kasner et al.
5,095,810 A 3/1992 Robinson
5,099,627 A 3/1992 Coulton et al.
5,122,095 A 6/1992 Wolfert
5,134,827 A 8/1992 Hartman
5,149,301 A 9/1992 Gates
5,167,579 A 12/1992 Rotter
5,238,450 A 8/1993 Rotter
D342,129 S 12/1993 Goetz, Jr.
5,288,269 A 2/1994 Hansen
5,302,444 A 4/1994 Jackson et al.
5,304,095 A 4/1994 Morris
5,326,318 A 7/1994 Rotter
5,328,406 A 7/1994 Morris, Jr.
5,331,783 A 7/1994 Kasner et al.
5,332,699 A 7/1994 Olds et al.
5,352,154 A 10/1994 Rotter
5,425,672 A 6/1995 Rotter
5,427,571 A 6/1995 Sells
5,439,417 A 8/1995 Sells
5,457,920 A 10/1995 Waltz
5,458,538 A 10/1995 MacLeod et al.
5,474,425 A 12/1995 Lawlor
5,542,224 A 8/1996 Olsen
5,542,882 A 8/1996 Sells
5,560,157 A 10/1996 Rotter
5,560,158 A 10/1996 Norton
5,561,953 A 10/1996 Rotter
5,569,629 A 10/1996 TenEyck et al.
5,573,844 A 11/1996 Donovan et al.
5,576,252 A 11/1996 Rapp et al.
5,585,312 A 12/1996 TenEyck et al.
5,596,847 A 1/1997 Stephenson
5,603,567 A 2/1997 Peacock
5,630,752 A 5/1997 Glubash
5,636,481 A 6/1997 DeZen
5,651,734 A 7/1997 Morris
5,673,521 A 10/1997 Coulton et al.
5,676,597 A 10/1997 Bettoli et al.
5,704,834 A 1/1998 Sells
5,772,502 A 6/1998 Smith
5,789,329 A 8/1998 Eastes et al.
5,797,222 A 8/1998 Martin
5,826,390 A 10/1998 Sacks
5,830,059 A 11/1998 Sells
5,832,677 A 11/1998 Kurttilla
5,851,932 A 12/1998 Dickson et al.
5,921,863 A 7/1999 Sells
5,934,995 A 8/1999 Morris et al.
5,935,886 A 8/1999 Jensen et al.
5,946,868 A 9/1999 Morris
5,947,817 A 9/1999 Morris et al.
5,948,535 A 9/1999 Chiurlo et al.
5,962,354 A 10/1999 Fyles et al.
5,971,848 A 10/1999 Nair et al.
5,996,289 A 12/1999 Allaster
5,997,977 A 12/1999 Zou et al.
6,015,343 A 1/2000 Castillo et al.
6,039,646 A 3/2000 Sells
6,063,470 A 5/2000 Zou et al.
6,068,551 A 5/2000 Oremland
6,086,755 A 7/2000 Tepper
6,101,847 A 8/2000 Shamp et al.
6,128,869 A 10/2000 Brotherton et al.
6,129,628 A 10/2000 O'Hagin et al.
6,138,735 A 10/2000 Gallo et al.
6,145,255 A 11/2000 Allaster
6,149,517 A 11/2000 Hansen
6,165,066 A 12/2000 Sharp et al.
6,174,119 B1 1/2001 Orr
6,212,833 B1 4/2001 Henderson
6,213,868 B1 4/2001 Sells
6,214,429 B1 4/2001 Zhou et al.
D442,273 S 5/2001 Pestell
6,227,963 B1 5/2001 Headrick
6,233,887 B1 5/2001 Smith
6,237,369 B1 5/2001 LeBlanc et al.
6,248,678 B1 6/2001 Pinckney
6,260,315 B1 7/2001 Smith
6,267,668 B1 7/2001 Morris
6,277,024 B1 8/2001 Coulton
RE37,388 E 9/2001 Kasner et al.
6,286,273 B1 9/2001 Villela et al.
6,296,912 B1 10/2001 Zickell
6,298,613 B1 10/2001 Coulton et al.
6,299,528 B1 10/2001 Hansen
6,302,785 B1 10/2001 McKinney et al.
6,306,786 B1 10/2001 Koyama et al.
6,314,760 B1 11/2001 Chenoweth
6,329,310 B1 12/2001 Peuchert et al.
6,357,193 B1 3/2002 Morris
6,361,434 B1 3/2002 Brandon
6,371,847 B2 4/2002 Headrick
6,399,527 B1 6/2002 Kishimoto et al.
6,418,692 B1 7/2002 Freshwater et al.
D462,790 S 9/2002 Bullinger et al.

(56) References Cited

U.S. PATENT DOCUMENTS 6,447,392 B1 9/2002 Henderson
6,450,882 B1 9/2002 Morris et al.
6,457,943 B1 10/2002 Olsen et al.
6,458,029 B2 10/2002 Morris
D465,839 S 11/2002 Sells
6,482,084 B2 11/2002 Hansen
6,487,826 B1 12/2002 McCorsley et al.
6,491,581 B1 12/2002 Mankowski
6,530,189 B2 3/2003 Freshwater et al.
6,537,147 B2 3/2003 Smith
6,540,508 B1 4/2003 Simpson et al.
6,558,251 B2 5/2003 Sells
6,565,431 B1 5/2003 Villela
6,578,325 B2 6/2003 Henderson
6,579,599 B1 6/2003 Blum et al.
6,589,113 B2 7/2003 Sells
6,595,849 B2 7/2003 Miller
6,598,356 B1 7/2003 Sells
6,599,184 B2 7/2003 Morris
6,623,354 B2 9/2003 Morris et al.
6,684,581 B2 * 2/2004 Robinson ..... E04D 13/176 454/365
6,686,304 B1 2/2004 Wallenberger
6,705,052 B1 3/2004 Larson
6,793,574 B1 9/2004 Robinson
6,809,050 B1 10/2004 McGinnis
D503,790 S 4/2005 Dodge et al.
6,881,144 B2 4/2005 Hansen et al.
6,913,530 B2 7/2005 Morris et al.
6,933,045 B2 8/2005 Tamura
6,933,252 B2 8/2005 Pierce
6,954,947 B1 10/2005 Williams, Jr.
D511,847 S 11/2005 Cipeliski
D511,848 S 11/2005 Cipelski
6,981,916 B2 1/2006 Coulton
6,991,535 B2 1/2006 Ciepliski et al.
6,998,361 B2 2/2006 Lewis
7,024,828 B2 4/2006 Headrick
7,044,852 B2 5/2006 Horton
D527,813 S 9/2006 Dodge et al.
7,143,557 B1 12/2006 Ayers, Jr.
7,165,363 B2 1/2007 Headrick et al.
7,182,688 B2 2/2007 Coulton
7,219,473 B2 5/2007 Mantyla et al.
D549,316 S 8/2007 O'Hagin et al.
7,259,118 B2 8/2007 Jubb et al.
D555,237 S 11/2007 O'Hagin
7,302,776 B2 12/2007 Duncan et al.
7,384,331 B2 6/2008 Coulton
D574,947 S 8/2008 Grisham et al.
7,449,419 B2 11/2008 Li
7,484,335 B1 2/2009 Dunlap
7,485,034 B2 2/2009 Sells
7,520,098 B1 4/2009 Martinique et al.
7,527,554 B2 5/2009 Schmid
7,537,518 B2 5/2009 Villela et al.
7,540,803 B2 6/2009 Sells
7,562,498 B2 7/2009 Galeazzo
7,591,109 B2 9/2009 Rotter
7,594,362 B2 9/2009 Sigmund et al.
D602,579 S 10/2009 Stone
7,604,536 B2 10/2009 Coulton et al.
7,610,725 B2 * 11/2009 Willert ..... E04D 13/152 454/250
7,644,545 B2 1/2010 Mankell et al.
7,662,037 B2 2/2010 Polston
D615,218 S 5/2010 Brubka
7,716,894 B2 5/2010 Jolitz
D618,331 S 6/2010 Lomanco
7,765,750 B2 8/2010 Duncan
7,765,754 B2 8/2010 Johnson et al.
7,766,735 B2 8/2010 Ciepliski et al.
7,823,343 B1 11/2010 Inzeo
D628,718 S 12/2010 Grubka
7,856,764 B2 12/2010 Korteum et al.
8,028,475 B2 10/2011 Sigmund et al.
8,061,102 B2 11/2011 Turek et al.
D654,161 S 2/2012 Holland et al.
8,136,322 B2 3/2012 Shadwell et al.
8,292,707 B2 10/2012 Grisham et al.
8,322,089 B2 12/2012 Railkar et al.
D694,394 S 11/2013 Polston
D710,985 S 8/2014 Gassman
2001/0019941 A1 9/2001 Headrick
2002/0000101 A1 1/2002 Chenoweth
2002/0045528 A1 4/2002 Kusuno et al.
2003/0077178 A1 4/2003 Stearns
2003/0166446 A1 9/2003 Lewis
2003/0188554 A1 10/2003 Baker et al.
2003/0207748 A1 11/2003 Wallenberger
2003/0224922 A1 12/2003 Wallenberger
2004/0029523 A1 2/2004 Morris et al.
2004/0088928 A1 5/2004 Headrick, II et al.
2004/0092379 A1 5/2004 Lewis
2004/0198216 A1 10/2004 Morris et al.
2004/0237428 A1 12/2004 Headrick et al.
2005/0014624 A1 1/2005 Jubb et al.
2005/0031703 A1 2/2005 Beier et al.
2005/0084440 A1 4/2005 Chacon et al.
2005/0085369 A1 4/2005 Jensen
2005/0090377 A1 4/2005 Shelestak et al.
2005/0130581 A1 6/2005 Dodge
2005/0130825 A1 6/2005 Kravchenko et al.
2005/0136830 A1 6/2005 Morris et al.
2005/0232828 A1 10/2005 Merry
2005/0234216 A1 10/2005 Klein et al.
2006/0003884 A1 1/2006 Nishizawa et al.
2006/0040608 A1 2/2006 Coulton
2006/0079173 A1 4/2006 Coulton et al.
2006/0116069 A1 6/2006 Urbanski et al.
2006/0154597 A1 7/2006 Coulton et al.
2006/0211366 A1 9/2006 Villela et al.
2006/0229010 A1 10/2006 Villela et al.
2006/0240762 A1 10/2006 Railkar et al.
2006/0257240 A1 11/2006 Naskali et al.
2007/0000192 A1 1/2007 Mantyla et al.
2007/0026789 A1 2/2007 Villela
2007/0049190 A1 * 3/2007 Singh ..... E04D 13/17 454/365
2007/0054612 A1 3/2007 Ehrman et al.
2007/0072539 A1 3/2007 Sells
2007/0072540 A1 3/2007 Ciepliski et al.
2007/0094953 A1 5/2007 Galeazzo et al.
2007/0105701 A1 5/2007 Hofmann et al.
2007/0107220 A1 5/2007 Bakhius et al.
2007/0117505 A1 5/2007 Wey et al.
2007/0213003 A1 9/2007 Railkar et al.
2007/0234650 A1 10/2007 Coulton et al.
2008/0009403 A1 1/2008 Hofmann et al.
2008/0064320 A1 3/2008 Polston
2008/0125028 A1 5/2008 Morris et al.
2008/0182507 A1 7/2008 Morris et al.
2008/0287054 A1 * 11/2008 Carlson ..... E04D 13/174 454/365
2008/0299892 A1 12/2008 Robinson
2009/0126286 A1 5/2009 Sigmund et al.
2009/0130969 A1 5/2009 Grisham et al.
2009/0166928 A1 7/2009 Carlson
2009/0233541 A1 9/2009 Holland et al.
2010/0043311 A1 2/2010 Chich et al.
2010/0043312 A1 2/2010 Chich et al.
2010/0112932 A1 5/2010 Grubka
2010/0144266 A1 6/2010 Lowe et al.
2010/0192478 A1 * 8/2010 Horton ..... B05D 5/02 52/11
2011/0030287 A1 2/2011 More
2011/0111609 A1 5/2011 Goto
2011/0111690 A1 5/2011 Henderson
2011/0124280 A1 5/2011 Railkar
2011/0138710 A1 6/2011 Reisdorf
2011/0154743 A1 6/2011 Railkar
2011/0195655 A1 8/2011 Holland et al.
2011/0201266 A1 8/2011 Henderson

(56) References Cited

U.S. PATENT DOCUMENTS

| | | | |
|---|---|---|---|
| 2011/0265407 | A1 | 11/2011 | Bryson |
| 2011/0277394 | A1 | 11/2011 | Chich et al. |
| 2013/0023197 | A1 | 1/2013 | Grisham et al. |

FOREIGN PATENT DOCUMENTS

| | | |
|---|---|---|
| GB | 2083204 | 3/1982 |
| GB | 2186898 | 8/1987 |
| GB | 2335666 | 9/1999 |
| GB | 2425319 | 10/2006 |
| JP | 58064243 | 4/1983 |
| WO | 07/055964 | 5/2007 |
| WO | 07/055968 | 5/2007 |

OTHER PUBLICATIONS

Office action from U.S. Appl. No. 29/434,133 dated Dec. 31, 2013.
Notice of Allowance from U.S. Appl. No. 29/434,133 dated Mar. 25, 2014.
SmartVent 6 Step Installation Guide, DCI Products, Inc., 10 pgs., 2011.
Office action from U.S. Appl. No. 12/393,261 dated Apr. 23, 2015.
Office action from U.S. Appl. No. 12/393,261 dated Dec. 17, 2015.
Office action from U.S. Appl. No. 12/393,261 dated Jul. 5, 2016.
Request for Inter Partes Reexamination of U.S. Pat. No. 6,482,084, Control No. 95/002,081 dated Aug. 16, 2012.
Defendant Owens Corning Corporation's Non-Infringement and Invalidity Contentions Pursuant to LPR 3.4 dated Feb. 20, 2012 in Civil Action No. 10-1699, *Air Vent, Inc.* v. *Owens Corning Corporation*, United States District Court for the Western District of Pennsylvania.
Complaint for Patent Infringement [Doc. 1] dated Dec. 17, 2010 in Civil Action No. 10-1699, *Air Vent, Inc.* v. *Owens Corning Corporation*, United States District Court for the Western District of Pennsylvania.
Plaintiff's Motion for Preliminary Injunction [Doc. 10] dated Feb. 14, 2011 in Civil Action No. 10-1699, *Air Vent, Inc.* v. *Owens Corning Corporation*, United States District Court for the Western District of Pennsylvania.
Plaintiff's Memorandum in Support of Motion for a Preliminary Injunction [Doc. 11] dated Feb. 14, 2011 in Civil Action No. 10-1699, *Air Vent, Inc.* v. *Owens Corning Corporation*, United States District Court for the Western District of Pennsylvania.
Declaration of Robert Bradley Holland and Exhibits 7-10 in Support of Plaintiff's Memorandum in Support of Motion for a Preliminary Injunction [Doc. 15] dated Feb. 15, 2011 in Civil Action No. 10-1699, *Air Vent, Inc.* v. *Owens Corning Corporation*, United States District Court for the Western District of Pennsylvania.
Defendant's Memorandum in Opposition to Air Vent, Inc.'s Motion for Preliminary Injunction [Doc. 25] dated Mar. 7, 2011 in Civil Action No. 10-1699, *Air Vent, Inc.* v. *Owens Corning Corporation*, United States District Court for the Western District of Pennsylvania.
Air Vent's Reply to Owens Corning's Opposition to Motion for a Preliminary Injunction [Doc. 32] dated Mar. 14, 2011 in Civil Action No. 10-1699, *Air Vent, Inc.* v. *Owens Corning Corporation*, United States District Court for the Western District of Pennsylvania.
Amended Complaint for Patent Infringement [Doc. 41] dated Jul. 14, 2011 in Civil Action No. 10-1699, *Air Vent, Inc.* v. *Owens Corning Corporation*, United States District Court for the Western District of Pennsylvania.
Memorandum in Support of Plaintiff's Motion for a Preliminary Injunction [Doc. 44] dated Jul. 26, 2011 in Civil Action No. 10-1699, *Air Vent, Inc.* v. *Owens Corning Corporation*, United States District Court for the Western District of Pennsylvania.
Defendant's Motion to Dismiss Count Three of Plaintiff's Amended Complaint Pursuant to Federal Rule of Civil Procedure 12(b)(6) [Doc. 45] in Civil Action No. 10-1699, *Air Vent, Inc.* v. *Owens Corning Corporation*, United States Court for the Western District of Pennsylvania—DATE.
Defendant's Memorandum in Support of its Motion to Dismiss Count Three of Plaintiff's Amended Complaint Pursuant to Federal Rule of Civil Procedure 12(b)(6) [Doc. 46] dated Aug. 1, 2011 in Civil Action No. 10-1699, *Air Vent, Inc.* v. *Owens Corning Corporation*, United States District Court for the Western District of Pennsylvania.
Defendant's Memorandum in Opposition to Air Vent, Inc.'s Renewed Motion for Preliminary Injunction [Doc. 49] dated Aug. 10, 2011 in Civil Action No. 10-1699, *Air Vent, Inc.* v. *Owens Corning Corporation*, United States District Court for the Western District of Pennsylvania.
Plaintiff's Memorandum in Opposition to Defendant's Motion to Dismiss [Doc. 52] dated Aug. 22, 2011 in Civil Action No. 10-1699, *Air Vent, Inc.* v. *Owens Corning Corporation*, United States District Court for the Western District of Pennsylvania.
Plaintiff's Reply to Defendant's Opposition to Motion for a Preliminary Injunction [Doc. 54] dated Aug. 26, 2011 in Civil Action No. 10-1699, *Air Vent, Inc.* v. *Owens Corning Corporation*, United States District Court for the Western District of Pennsylvania.
Defendant's Reply in Support its Motion to Dismiss Count Three of the Amended Complaint [Doc. 57] dated Sep. 8, 2011 in Civil Action No. 10-1699, *Air Vent, Inc.* v. *Owens Corning Corporation*, United States District Court for the Western District of Pennsylvania.
Plaintiff's Surreply in Opposition to Defendant's Motion to Dismiss [Doc. 60] dated Sep. 12, 2011 in Civil Action No. 10-1699, *Air Vent, Inc.* v. *Owens Corning Corporation*, United States District Court for the Western District of Pennsylvania.
Reply to Plaintiff's Surreply in Opposition to Defendant's Motion to Dismiss Count Three of the Amended Complaint [Doc. 63] dated Sep. 16, 2011 in Civil Action No. 10-1699, *Air Vent, Inc.* v. *Owens Corning Corporation*, United States District Court for the Western District of Pennsylvania.
Defendant's Motion for Summary Judgment of Non-Infringement of U.S. Pat. No. 6,299,528 and U.S. Pat. No. 6,482,084 [Doc. 64] dated Oct. 25, 2011 in Civil Action No. 10-1699, *Air Vent, Inc.* v. *Owens Corning Corporation*, United States District Court for the Western District of Pennsylvania.
Defendant's Memorandum in Support of its Motion for Summary Judgment of U.S. Pat. No. 6,299,528 and U.S. Pat No. 6,482,084 [Doc. 65] dated Oct. 25, 2011 in Civil Action No. 10-1699, *Air Vent, Inc.* v. *Owens Corning Corporation*, United States District Court for the Western District of Pennsylvania.
Concise Statement of Undisputed Facts in Support of Defendant's Motion for Summary Judgment of Non-Infringement of U.S. Pat. No. 6,299,528 and U.S. Pat No. 6,482,084 [Doc. 66] dated Oct. 25, 2011 in Civil Action No. 10-1699, *Air Vent, Inc.* v. *Owens Corning Corporation*, United States District Court for the Western District of Pennsylvania.
Appendix of Exhibits in Support of Defendant's Concise Statement of Undisputed Facts in Support of Defendant's Motion for Summary Judgment of Non-Infringement of U.S. Pat. No. 6,299,528 and U.S. Pat. No. 6,482,084 [Doc. 67] dated Oct. 25, 2011 in Civil Action No. 10-1699, *Air Vent, Inc.* v. *Owens Corning Corporation*, United States District Court for the Western District of Pennsylvania.
Defendant Owens Corning Corporation's Answer, Affirmative Defenses and Counterclaims to Plaintiff's Amended Complaint for Patent Infringement [Doc. 69] dated Nov. 14, 2011 in Civil Action No. 10-1699, *Air Vent, Inc.* v. *Owens Corning Corporation*, United States District Court for the Western District of Pennsylvania.
Plaintiff Air Vent, Inc.'s Answer to Defendant Owens Corning Corporation's Counterclaims [Doc. 71] dated Nov. 22, 2011 in Civil Action No. 10-1699, *Air Vent, Inc.* v. *Owens Corning Corporation*, United States District Court for the Western District of Pennsylvania.
Plaintiff's Memorandum in Opposition to Defendant's Motion for Summary Judgment of Non-Infringement of U.S. Pat. No. 6,299,528 and U.S. Pat No. 6,482,04 [Doc. 72] dated Nov. 22, 2011 in Civil

(56) References Cited

OTHER PUBLICATIONS

Action No. 10-1699, *Air Vent, Inc.* v. *Owens Corning Corporation*, United States District Court for the Western District of Pennsylvania.
Declaration of David L. Roodvoets in Support of Plaintiff's Memorandum in Opposition to Defendant's Motion for Summary Judgment of Non-Infringement of U.S. Pat. No. 6,299,528 and U.S. Pat. No. 6,482,04 [Doc. 73] dated Nov. 22, 2011 in Civil Action No. 10-1699, *Air Vent, Inc.* v. *Owens Corning Corporation*, United States District Court for the Western District of Pennsylvania.
Plaintiff's Response to Defendant's Concise Statement of Facts in Opposition to Defendant's Motion for Summary Judgment [Doc. 75] dated Nov. 22, 2011 in Civil Action No. 10-1699, *Air Vent, Inc.* v. *Owens Corning Corporation*, United States District Court for the Western District of Pennsylvania.
Defendant's Reply in Support of its Motion for Summary Judgment of Non-Infringement of U.S. Pat. No. 6,299,528 and U.S. Pat. No. 6,482,084 [Doc. 80] dated Dec. 6, 2011 in Civil Action No. 10-1699, *Air Vent, Inc.* v. *Owens Corning Corporation*, United States District Court for the Western District of Pennsylvania.
"Plaintiffs Surreply in Opposition to Defendant's Motion for Summary Judgment of Non-Infringement [Doc. 83] dated Dec. 14, 2011 in Civil Action No. 10-1699, *Air Vent, Inc.* v. *Owens Corning Corporation*, United States District Court for the Western District of Pennsylvania".
Defendant's Reply to Plaintiff's Surreply [Doc. 87] dated Dec. 23, 2011 in Civil Action No. 10-1699, *Air Vent, Inc.* v. *Owens Corning Corporation*, United States District Court for the Western District of Pennsylvania.
Plaintiff's Reply to Defendant's Reply [Doc. 92] dated Dec. 28, 2011 in Civil Action No. 10-1699, *Air Vent, Inc.* v. *Owens Corning Corporation*, United States District Court for the Western District of Pennsylvania.
Plaintiff's Second Amended Complaint for Patent Infringement [Doc. 130] dated Aug. 29, 2012 in Civil Action No. 10-1699, *Air Vent, Inc.* v. *Owens Corning Corporation*, United States District Court for the Western District of Pennsylvania.
Defendant Owens Corning Corporation's Answer, Affirmative Defenses and Counterclaims to Plaintiff's Second Amended Complaint for Patent Infringement [Doc. 134] dated Sep. 19, 2012 in Civil Action No. 10-1699, *Air Vent, Inc.* v. *Owens Corning Corporation*, United States District Court for the Western District of Pennsylvania.
Declaration of David L. Roodvoets in Support of Plaintiff's Opposition to Defendant's Motion to Stay [Doc. 136] dated Sep. 24, 2012 in Civil Action No. 10-1699, *Air Vent, Inc.* v. *Owens Corning Corporation*, United States District Court for the Western District of Pennsylvania.
Notice of Allowance from U.S. Appl. No. 29/332,162 dated Jul. 15, 2009.
Notice of Allowance from U.S. Appl. No. 29/327,214 dated Sep. 13, 2010.
Office action from U.S. Appl. No. 11/267,739 dated Sep. 24, 2008.
Office action from U.S. Appl. No. 11/267,739 dated Dec. 18, 2008.
Office action from U.S. Appl. No. 11/267,702 dated Dec. 23, 2008.
Office action from U.S. Appl. No. 12/393,261 dated Aug. 16, 2012.
Office action from U.S. Appl. No. 12/393,261 dated Feb. 15, 2013.
Advisory action from U.S. Appl. No. 12/393,261 dated May 1, 2013.
Installation Instructions for Owens Corning VentSure Rigid Strip Ridge Vent dated Mar. 2000.
Installation Instructions for Owens Corning VentSure Rigid Strip Ridge Vent dated Oct. 1999 (6 pages).
Owens Corning Press Release—Great Exterior Makeover—dated Oct. 13, 1999.
Request for Inter Partes Reexamination of U.S. Pat. No. 6,299,528, Control No. 95/002,080 dated Aug. 16, 2012.
Part 2—Request for Inter Partes Reexamination of U.S. Pat. No. 6,793,574, Control No. 95/001,952 dated Mar. 29, 2012 (pp. 101-149 and exhibits).
Office Action granting Inter Partes Reexamination of U.S. Pat. No. 6,793,574, Control No. 95/001,952 dated May 9, 2012.
Office Action regarding Inter Partes Reexamination of U.S. Pat. No. 6,793,574, Control No. 95/001,952 dated May 9, 2012.
Patent Owner's Response Pursuant to 37 CFR Section 1.945 regarding Inter Partes Reexamination of U.S. Pat. No. 6,793,574, Control No. 95/001,952 dated Jul. 5, 2012.
Requester Comments After Patent Owner's Response regarding Inter Partes Reexamination of U.S. Pat. No. 6,793,574, Control No. 95/001,952 dated Aug. 6, 2012.
Submission of signed Declaration of Denise Laytart in support of Requester Comments After Patent Owner's Response regarding Inter Partes Reexamination of U.S. Pat. No. 6,793,574, Control No. 95/001,952 dated Aug. 13, 2012.
Patent Owner's Amendment and Response regarding Inter Partes Reexamination of U.S. Pat. No. 6,793,574, Control No. 95/001,952 dated Sep. 26, 2012.
Office Action closing prosecution regarding Inter Partes Reexamination of U.S. Pat. No. 6,793,574, Control No. 95/001,952 dated Aug. 28, 2012.
Patent Owner's Petition Under 37 CFR Section 1.182—Request for Continued Reexamination regarding Inter Partes Reexamination of U.S. Pat. No. 6,793,574, Control No. 95/001,952 dated Sep. 27, 2012.
Patent Owner's Amendment and Response regarding Inter Partes Reexamination of U.S. Pat. No. 6,793,574, Control No. 95/001,952 dated Oct. 23, 2012.
Requester Comments after Patent Owner's Response regarding Inter Partes Reexamination of U.S. Pat. No. 6,793,574, Control No. 95/001,952 dated Oct. 26, 2012.
Office Action denying Request for Inter Partes Reexamination of U.S. Pat. No. 6,482,084, Control No. 95/001,953 dated May 11, 2012.
Requester's Petition Under 37 CFR Sections 1.927 and 1.181 for Supervisory Review of Refusal to Order Reexamination of Claims 1-8 of U.S. Pat. No. 6,482,084 regarding Request for Inter Partes Reexamination of U.S. Pat. No. 6,482,084, Control No. 95/001,953 dated Jun. 8, 2012.
Decision on Petition Under 37 CFR 1.181 and 1.927 regarding Request for Inter Partes Reexamination of U.S. Pat. No. 6,482,084, Control No. 95/001,953 dated Jul. 25, 2012.
Office Action denying Request for Inter Partes Reexamination of U.S. Pat. No. 6,299,528, Control No. 95/001,954 dated May 11, 2012.
Requester's Petition Under 37 CFR Sections 1.927 and 1.181 for Supervisory Review of Refusal to Order Reexamination of Claims 1-3 of U.S. Pat. No. 6,299,5284 regarding Request for Inter Partes Reexamination of U.S. Pat. No. 6,299,528, Control No. 95/001,954 dated Jun. 8, 2012.
Decision on Petition Under 37 CFR 1.181 and 1.927 regarding Request for Inter Partes Reexamination of U.S. Pat. No. 6,299,528, Control No. 95/001,954 dated Jul. 25, 2012.
Office Action granting Request for Inter Partes Reexamination of U.S. Pat. No. 6,299,528, Control No. 95/002,080 dated Sep. 13, 2012.
Office Action regarding Request for Inter Partes Reexamination of U.S. Pat. No. 6,299,528, Control No. 95/002,080 dated Sep. 13, 2012.
Patent Owner Air Vent, Inc.'s Response to Office Action of Sep. 13, 2012 regarding Request for Inter Partes Reexamination of U.S. Pat. No. 6,299,528, Control No. 95/002,080 dated Nov. 12, 2012.
Requestor Comments after Patent Owner's Response regarding Request for Inter Partes Reexamination of U.S. Pat. No. 6,299,528, Control No. 95/002,080 dated Dec. 12, 2012.
Office Action granting Request for Inter Partes Reexamination of U.S. Pat. No. 6,482,084, Control No. 95/002,081 dated Sep. 13, 2012.
Office Action regarding Request for Inter Partes Reexamination of U.S. Pat. No. 6,482,084, Control No. 95/002,081 dated Sep. 13, 2012.
Patent Owner Air Vent, Inc.'s Response to Office Action of Sep. 13, 2012 regarding Request for Inter Partes Reexamination of U.S. Pat. No. 6,482,084, Control No. 95/002,081 dated Nov. 12, 2012.

(56) References Cited

OTHER PUBLICATIONS

Requestor Comments after Patent Owner's Response regarding Request for Inter Partes Reexamination of U.S. Pat. No. 6,482,084, Control No. 95/002,081 dated Dec. 12, 2012.
Part 1—Request for Inter Partes Reexamination of U.S. Pat. No. 6,482,084, Control No. 95/001,953 dated Mar. 30, 2012 (pp. 1-135).
Part 2—Request for Inter Partes Reexamination of U.S. Pat. No. 6,482,084, Control No. 95/001,953 dated Mar. 30, 2012 (pp. 136-221 and exhibits).
Part 1—Request for Inter Partes Reexamination of U.S. Pat. No. 6,299,528, Control No. 95/001,954 dated Mar. 30, 2012 (pp. 1-100).
Part 2—Request for Inter Partes Reexamination of U.S. Pat. No. 6,299,528, Control No. 95/001,954 dated Mar. 30, 2012 (pp. 101-142 and exhibits).
Office action from U.S. Appl. No. 12/393,261 dated Oct. 7, 2014.
Office action from U.S. Appl. No. 12/393,261 dated Jan. 13, 2017.
Advisory Action from U.S. Appl. No. 12/393,261 dated May 5, 2017.
Office action from U.S. Appl. No. 12/393,261 dated Sep. 21, 2017.

* cited by examiner

ROOF DECK INTAKE VENT

RELATED APPLICATIONS

The present application is a continuation-in-part of U.S. Design patent application Ser. No. 29/434,133, filed on Nov. 8, 2012, titled "Roof Vent." U.S. Design patent application Ser. No. 29/434,133 is incorporated herein by reference in its entirety.

BACKGROUND

Buildings, such as for example residential buildings, are typically covered by a sloping roof planes. The interior portion of the building located directly below the sloping roof planes forms a space called an attic. If unventilated or under-ventilated, condensation can form on the interior surfaces within the attic. The condensation can cause damage to various building components within the attic, such as for example insulation, as well as potentially causing damage to the building structure of the attic. In addition, unventilated or under-ventilated spaces are known to cause ice blockages ("ice dams") on the sloping roof planes. The ice blockages can cause water to damage portions of the various building components forming the roof and the attic.

Accordingly it is known to ventilate attics, thereby helping to prevent the formation of condensation. Some buildings are formed with structures and mechanisms that facilitate attic ventilation. The structures and mechanisms can operate in active or passive manners. An example of a structure configured to actively facilitate attic ventilation is an attic fan. An attic fan can be positioned at one end of the attic, typically adjacent an attic gable vent, or positioned adjacent a roof vent. The attic fan is configured to exhaust air within the attic and replace the exhausted air with fresh air.

Examples of structures configured to passively facilitate attic ventilation include ridge vents and soffit vents. Ridge vents are structures positioned at the roof ridge, which is the intersection of the uppermost sloping roof planes. In some cases, the ridge vents are designed to cooperate with the soffit vents, positioned near the gutters, to allow a flow of air to enter the soffit vents, travel through a space between adjoining roof rafters to the attic, travel through the attic and exit through the ridge vents.

However, some buildings may not be formed with structures, or include mechanisms, that facilitate ventilation of an attic. It would be advantageous if a ventilation system for an attic could be provided for buildings with or without ventilating structures or mechanisms.

SUMMARY OF THE INVENTION

According to this invention there is provided a roof deck intake vent. The roof deck intake vent includes a first portion connected to a second portion. The first portion is further connected to an upper edge and the second portion further connected to a lower edge. Opposing first and second side walls are connected to the first and second portions. The opposing first and second side walls extend from the upper edge to the lower edge. The first and second side walls form an extension having a lower surface. The first portion, upper edge, and the extension cooperate to form an air intake, such that air entering the roof deck intake vent enters the vent through the lower surface of the extension when the roof deck intake vent is installed on an edge or eave of the roof.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, a roof deck intake vent (hereafter "vent") is provided. It will be understood the term "ridge" refers to the intersection of the uppermost sloping roof planes. The term "roof deck" is defined to mean the plane defined by a roof surface. The term "sheathing", as used herein, is defined to mean exterior grade boards used as a roof deck material. The teem "roof deck", as used herein, is defined to mean the surface installed over the supporting framing members to which the roofing is applied. The term "louvers" as used herein, is defined to mean a quantity of openings positioned in a ridge vent and/or an intake vent and used for ventilation purposes.

Figure 1:
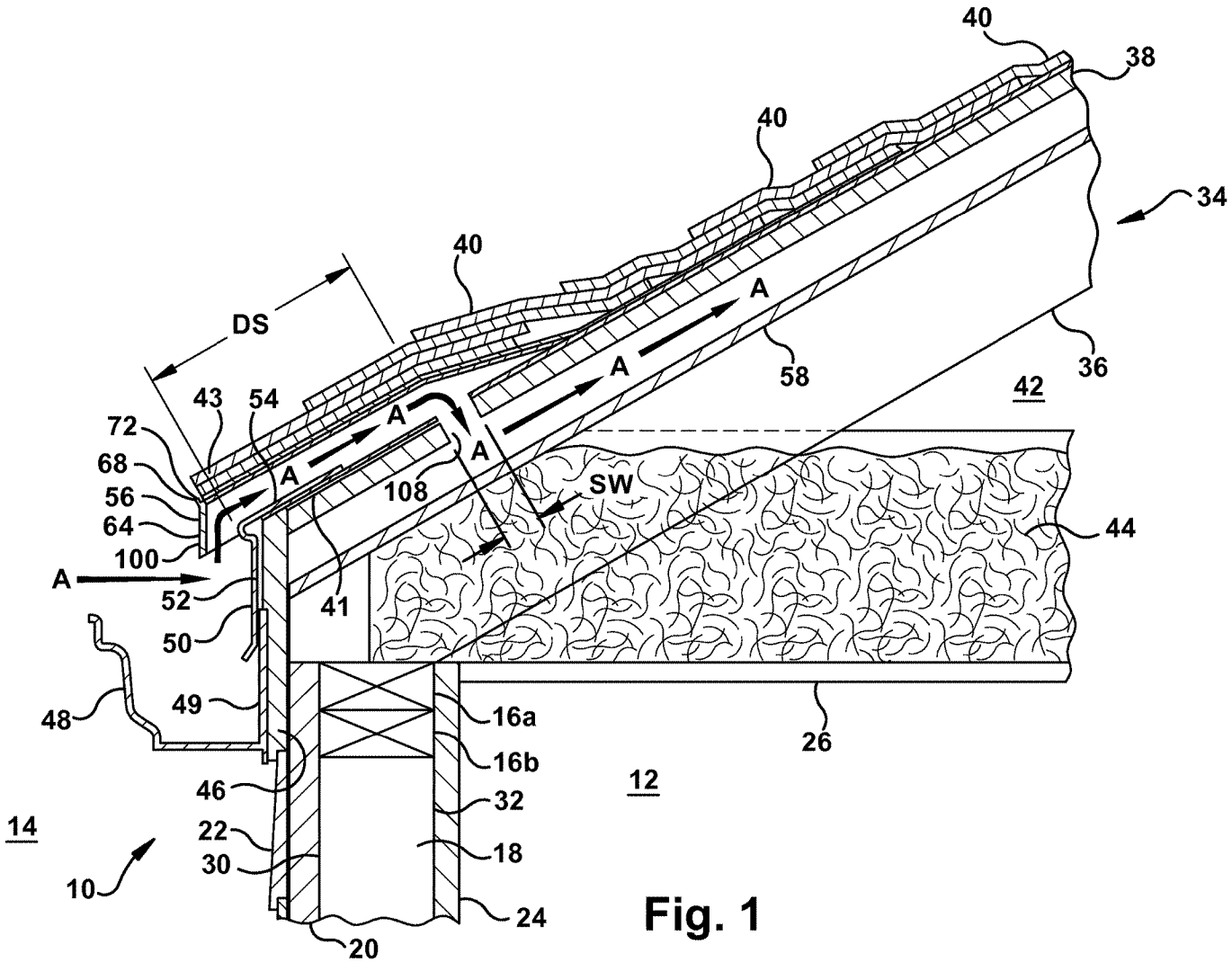
FIG. 1 is a side view, in elevation, of a portion of a building structure incorporating a first embodiment of a roof deck intake vent.

Referring now to FIG. 1, one example of an exterior building sidewall (hereafter "sidewall") is shown generally at 10. The sidewall 10 is configured to separate the interior areas 12 of the building from areas 14 exterior to the building, as well as providing a structural, protective and aesthetically pleasing covering to the sides of the building. The sidewall 10 can be formed from various structural framing members, such as the non-limiting examples of top plates 16*a* and 16*b*, and studs 18 extending from the top plates, 16*a* and 16*b*, to bottom plates (not shown). The top plates 16*a* and 16*b*, studs 18 and bottom plates can be configured to provide surfaces to which additional framing members or wall panels can be attached. In certain embodiment, the top plates 16*a* and 16*b*, studs 18 and bottom plates are made of wood. In other embodiments, the top plates 16*a* and 16*b*, studs 18 and bottom plates can be made of other desired materials, including the non-limiting example of steel. The top plates 16*a* and 16*b*, studs 18 and bottom plates can have any desired dimensions.

Referring again to FIG. 1, the sidewall 10 has an exterior surface 30 and an interior surface 32. The exterior surface 30 of the sidewall 10 is covered by an exterior sheathing 20 that is attached to the various structural framing members. The exterior sheathing 20 is configured to provide rigidity to the sidewall 10 and also configured to provide a surface for exterior wall coverings 22. In the illustrated embodiment, the exterior sheathing 20 is made of oriented strand board (OSB). In other embodiments, the exterior sheathing 20 can be made of other materials, such as for example plywood, waferboard, rigid foam or fiberboard, sufficient to provide rigidity to the sidewall 10 and to provide a surface for the exterior wall coverings 22.

The exterior wall covering 22 is configured to provide a protective and aesthetically pleasing covering to the sidewall 10. The exterior wall covering 22 can be made of any suitable materials, such as for example brick, wood, stucco or vinyl siding, sufficient to provide a protective and aesthetically pleasing covering to the sidewall 10.

The interior surface 32 of the sidewall 10 can be covered by a construction material 24. In the embodiment illustrated in FIG. 1, the construction material 24 is formed from sections or panels of gypsum or drywall. In other embodiments, the construction material 24 can be any desired material or combination of materials, such as the non-limiting examples of paneling, tile or masonry products.

Referring again to FIG. 1, a ceiling 26 is formed within the interior areas 12 of the building, adjacent the upper portions of the sidewall 10. The ceiling 26 can be attached to ceiling joists (not shown) and can be made from any desired materials, including the non-limiting examples of ceiling tile, drywall or gypsum. Optionally, the ceiling 26 can be covered by ceiling covering materials (not shown), such as for example paint or tile. In still other embodiments, the ceiling 26 can optionally include vapor barriers or vapor retarders (not shown).

A roof structure 34 is connected to the sidewall 10. In the illustrated embodiment, the roof structure 34 includes a plurality of roof rafters 36 attached to the sidewall 10. The roof rafters 36 are configured to support other structures, such as for example, a roof deck 38 and a plurality of overlapping shingles 40. In the illustrated embodiment, the roof rafters 36 are made from framing lumber, having sizes including, but not limited to 2.0 inches thick by 10.0 inches wide. Alternatively, the roof rafters 36 can be made from other desired materials and have other desired sizes. In the illustrated embodiment, the roof deck 38 is formed from panel-based materials such as oriented strand board (OSB). In other embodiments, the roof deck 38 can be made of other materials, such as for example plywood. While the illustrated embodiment shows the roof structure 34 to be formed from roof rafters 36, a roof deck 38 and shingles 40, it should be understood that in other embodiments, the roof structure 34 can include or be formed from other desired structures. It should be further understood that the shingles 40 can be any desired roofing material.

In certain embodiments, portions of the roof structure 34 can further include a first ice and water barrier layer 41 positioned between the roof deck 38 and the shingles 40. The first ice and water barrier layer 41 is configured to protect the roof structure from wind driven rain and from areas of the roof structure where water has a tendency to collect or flow and thereby form an ice dam. The first ice and water barrier layer 41 can be formed from any desired materials. While the embodiment illustrated in FIG. 1 shows a first ice and water barrier layer 41, it should be understood that some regional code authorities require the use of the ice and water barrier layer 41 and other regional code authorities require a standard roofing underlayment in lieu of an ice and water barrier layer. Accordingly, the use of the term "ice and water barrier layer", as used herein, is defined to mean either an ice and water barrier layer or a standard roofing underlayment.

Referring again to FIG. 1, a plurality of fascia boards 46 can be connected to the exterior sheathing 20 and the roof structure 34. The fascia boards 46 are configured for several purposes including creating a smooth, even appearance on the edge of the roof structure 34, protecting the roof and the interior of the house from weather damage and as a point of attachment for a plurality of gutters 48. In certain embodiments, the fascia boards 46 can be made from wood materials such as for example cedar. In other embodiments, the fascia boards 46 can be formed from other desired materials, including the non-limiting examples of polymeric materials or cementitious materials.

As discussed above, the gutters 48 are attached to the fascia boards 46. The gutters 48 are configured to catch rain water flowing from the roof structure 34 and provide a conduit for the rain water to flow to downspouts (not shown). The gutters 48 can have any desired cross-sectional shape and can be attached to the fascia boards 46 in any desired manner. The gutters 48 have a vertical segment 49 positioned against the fascia boards 46.

Referring again to FIG. 1, in one exemplary embodiment the building structure includes a drip edge or gutter apron 50, which are known to those of ordinary skill in the art. In this application, the terms "drip edge" and "gutter apron" are used interchangeably, since they perform essentially the same function, and even though drip edges and gutter aprons may have different physical configurations. In the illustrated embodiment, a drip edge 50 includes a first segment 52 and a second segment 54. Generally, the drip edge 50 is positioned such that the first segment 52 of the drip edge 50 covers the vertical segment 49 of the gutter 48 and the second segment 54 of the drip edge 50 is between the first ice and water barrier layer 41 and a roof deck intake vent 56. The drip edge 50 is configured to protect the roof deck 38 and the fascia boards 46 at the edge of the roof structure 34, as well as help water drip clear of the underlying exterior sidewall 10 and into the gutter 48. The drip edge 50 can be made from any desired material, including the non-limiting examples of sheet metal and polymeric materials. The roof deck intake vent 56 will be discussed in more detail below.

Referring again to FIG. 1, an attic 42 can be formed in the space between the ceiling 26 and the roof structure 34. Optionally, one of more layers of insulation 44 can be installed in the attic 42 and positioned over the ceiling 26 to insulate the interior areas 12 of the building. The layers of insulation 44 can be any desired type of insulation, such as for example batts or blankets of fiberous insulation or loosefill insulation, sufficient to insulate the interior areas 12 of the building. Additionally, the layer of insulation 44 can have any desired depth.

In certain embodiments, a plurality of rafter vents 58 is installed to the interior side of the roof deck 58 and between adjacent rafters 36. The rafter vents 58 are configured to create spaces between adjacent rafters and the insulation layer 44 such as to allow air to flow freely up the rafters 36 and into the attic 42. One example of a rafter vent 58 is the Raft-R-Mate, marketed by Owens Corning, headquartered in Toledo, Ohio. However, it should be appreciated that other rafter vents 58 can be used.

Referring again to FIG. 1 and as discussed above, the roof deck intake vent 56 (hereafter "intake vent") is positioned at the lower edge of the roof structure 34, between the first ice and water barrier layer 41 and a second ice and water barrier layer 68. Generally, the intake vent 56 is configured as a conduit, to allow a flow of air external to the building to enter the roof structure 34 through a slot formed in the roof deck 38 and flow freely up the rafters 36 and into the attic 42, the flow of air is shown by the direction arrows A.

The roof vent can take a wide variety of different forms. For example, FIGS. 2, 3, 4, 5, and 6 illustrate a first exemplary embodiment of an intake vent, FIGS. 2A, 3A, 4A, 5A, and 6A illustrate a second exemplary embodiment of an intake vent, and FIGS. 8-11 illustrate features that can optionally be included in either embodiment of the intake vent 56. Any of the features of the first embodiment can be included in the vent of the second embodiment and vice versa. Further, roof vents of the present invention can be constructed using any combination or sub-combination of the features shown and described in this patent application. The roof vents 56 are described herein primarily in view of the Figures of the first embodiment, with only the differences of the second embodiment being described.

Referring now to FIGS. 2 and 3 and 2A, 2B, and 3A, the intake vent 56 includes a plurality of different portions, each having a different slope. In the exemplary embodiment illustrated by FIGS. 2 and 3, the intake vent 56 includes a first portion 60 and a second portion 62. The first portion 60 and the second portion 62 each comprise a wall having a top surface, 60 *a* and 62 *a*, respectively and a bottom surface 60 *b* and 62 *b*, respectively. The first portion wall 60 is connected to a lower edge 64 and the second portion wall 62 is connected to an upper edge 66.

Figure 2:
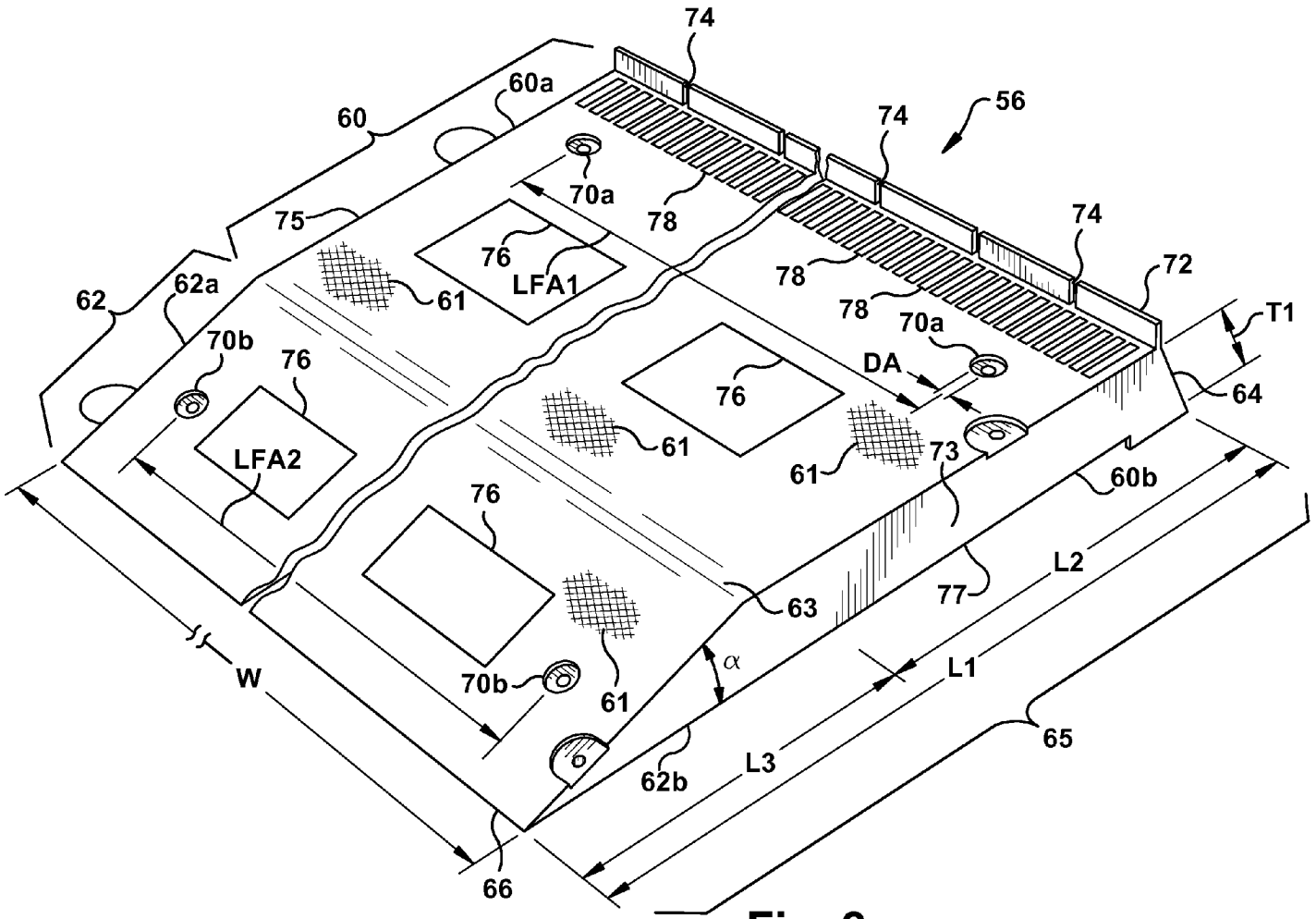
FIG. 2 is a partial perspective view of the top of the roof deck intake vent of FIG. 1.

As can be seen by FIG. 2, the top surfaces, 60*a* and 62*a*, form distinct planes that intersect at a transition line 63 or profile break. Accordingly, the intake vent 56 has a top surface 65 formed from the intersecting planes formed by the top surfaces, 60*a* and 62*a*.

Figure 2A:
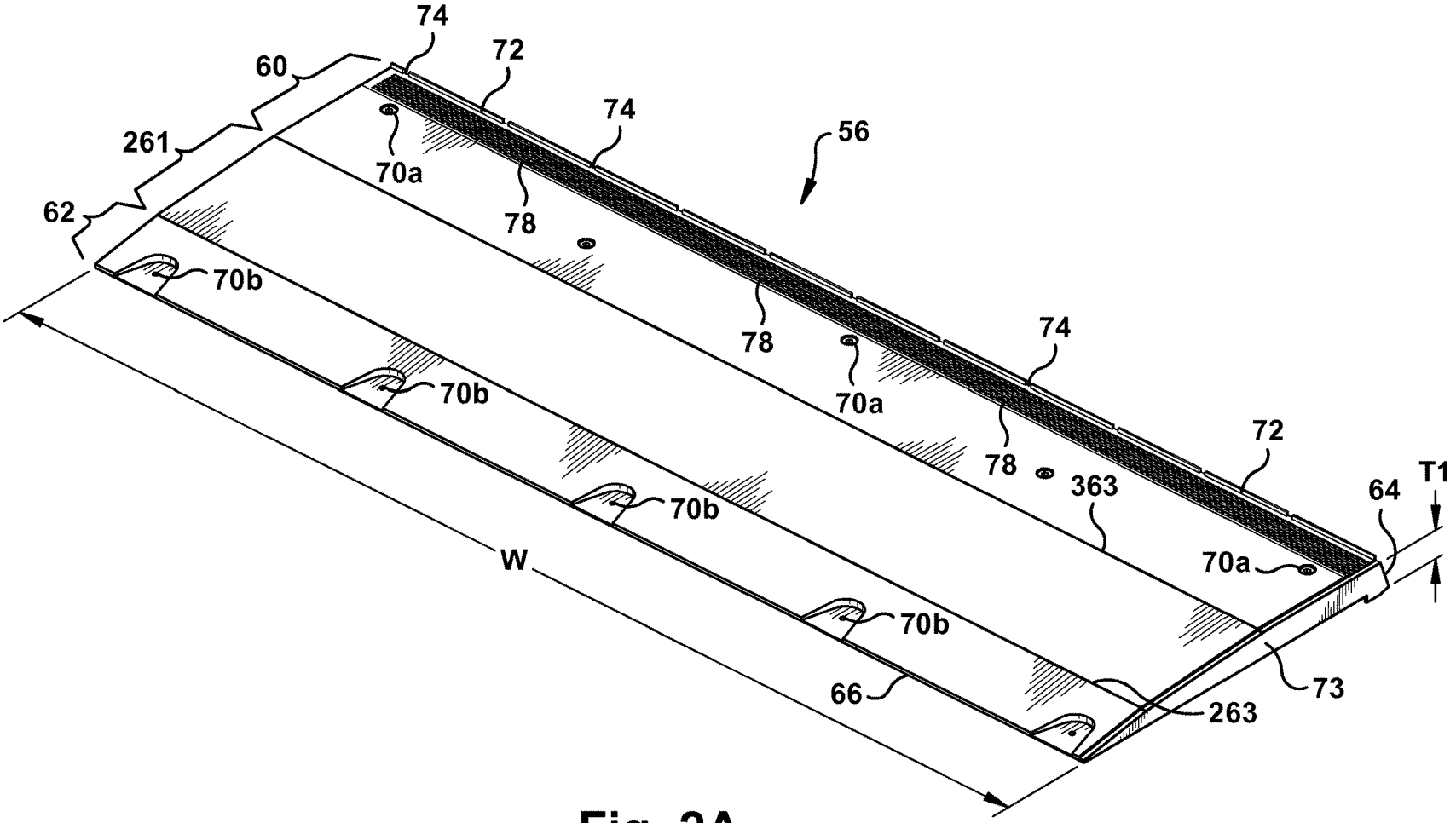
FIG. 2A is a perspective view of a second embodiment of a roof deck intake vent.
Figure 2B:
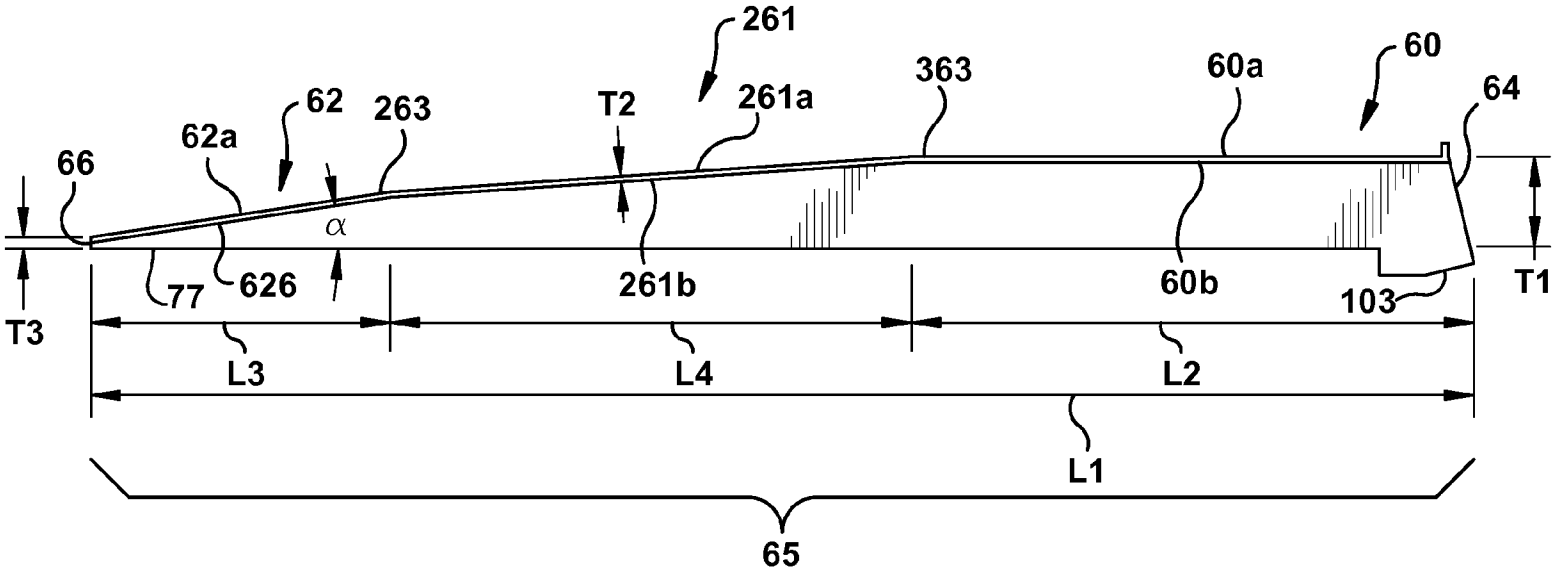
FIG. 2B is a side view of the roof deck intake vent illustrated by FIG. 2A.
Figure 3:
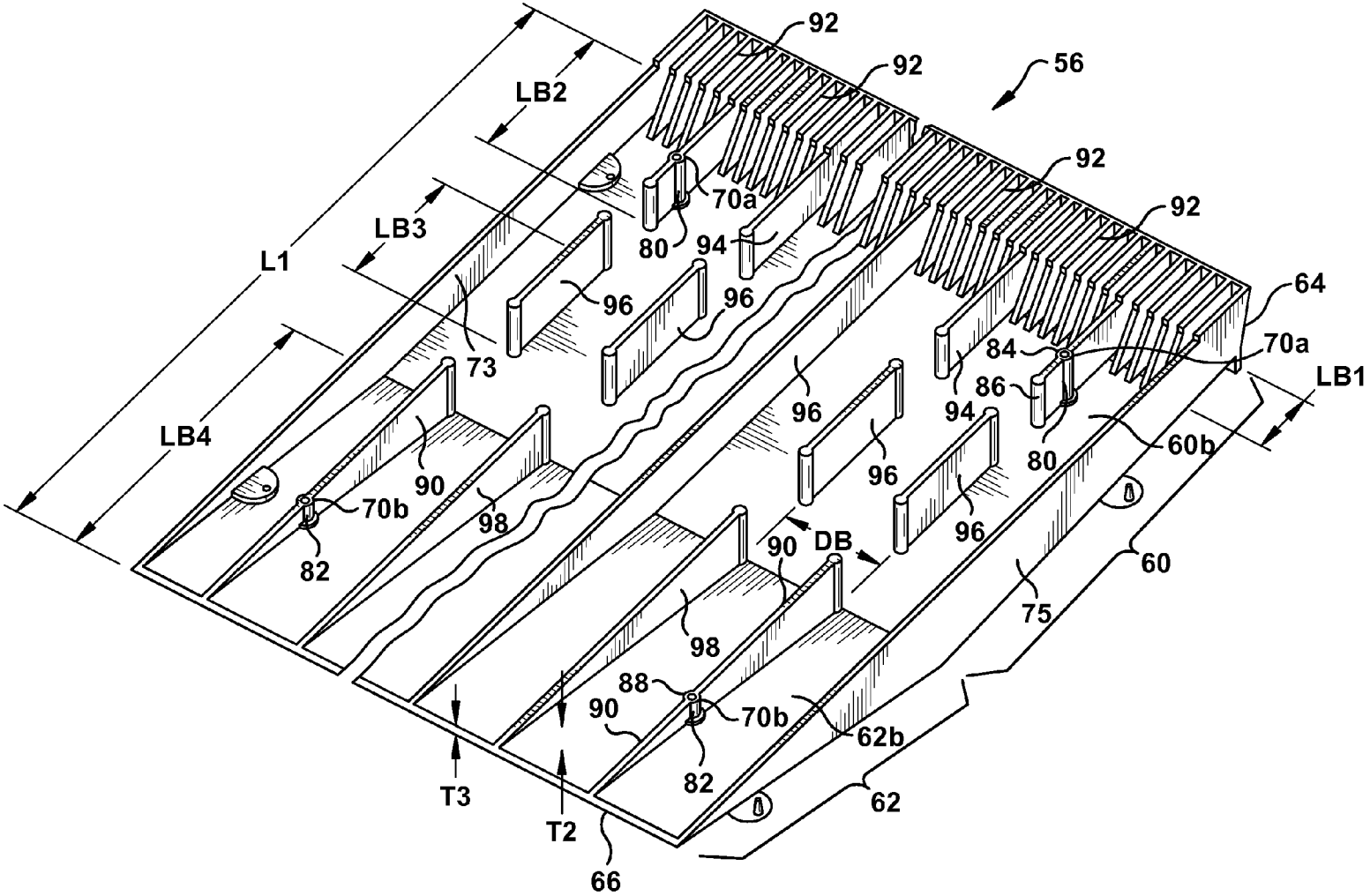
FIG. 3 is a partial perspective view of the bottom of the roof deck intake vent of FIG. 1.
Figure 3A:
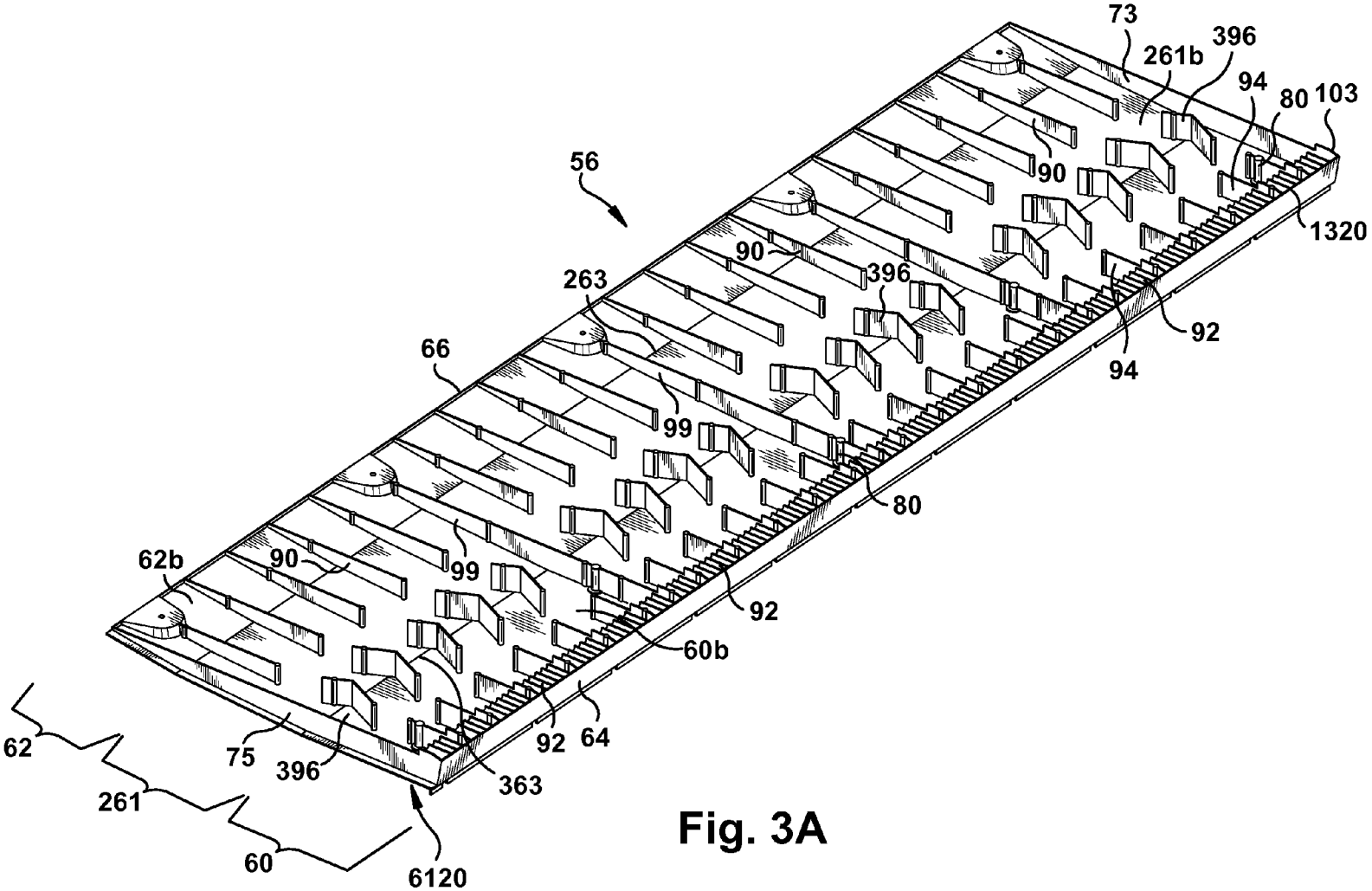
FIG. 3A is a perspective view of the bottom of the roof deck intake vent of FIG. 2A.

In the exemplary embodiment illustrated by FIGS. 2A, 2B, and 3A, the intake vent 56 includes a first portion 60 and a second portion 62 that are spaced apart by a middle or transition portion 261. The first portion 60, the middle or transition portion 261, and the second portion 62 each comprise a wall having a top surface, 60 *a*, 261 *a*, and 62 *a*, respectively and a bottom surface 60 *b*, 261 *b*, and 62 *b*, respectively. The first portion 60 is connected to the lower edge 64 and the second portion 62 is connected to the upper edge 66.

As can be seen by FIGS. 2A and 2B, the top surfaces, 60*a*, 261*a*, and 62*a*, form distinct planes that intersect. The top surface 60*a* of the first portion 60 intersects the top surface 261*a* of the middle portion at transition line 363 or profile break. The top surface 62*a* of the second portion 62 intersects the top surface 261*a* of the middle portion at transition line 263 or profile break. Accordingly, the intake vent 56 has a top surface 65 formed from the three intersecting planes formed by the top surfaces, 60*a*, 261*a*, and 62*a*. The vent 56 may have any number of intersecting top surfaces. In the illustrated embodiment, the top surfaces are illustrated as being planar. However, in other embodiments, the top surfaces may have other shapes.

Referring now to FIG. 2, at one end of the intake vent 56, a first side wall 73 is connected to the first and second portions, 60 and 62, and extends from the lower edge 64 to the upper edge 66. Similarly, at the other end of the intake vent 56, a second side wall 75 is connected to the first and second portions, 60 and 62, and extends from the lower edge 64 to the upper edge 66. The first side wall 73 has a bottom edge 77 and the second side wall 75 has a bottom edge 79 (not shown for purposes of clarity). The first side wall 73 and the second side wall 75 each include a main portion extending from the upper edge 66 to an extension portion, the extension portion extending from the main portion to the lower edge 64.

In the exemplary embodiment illustrated by FIGS. 2A and 2B, at one end of the intake vent 56, the first side wall 73 is connected to the first, second, and transition portions, 60, 62, and 261, and extends from the lower edge 64 to the upper edge 66. Similarly, at the other end of the intake vent 56, a second side wall 75 is connected to the first, second, and transition portions, 60, 62, and 261, and extends from the lower edge 64 to the upper edge 66.

In each illustrated embodiment, the lower edge 64 of the first portion 60 is a continuous structure that forms a wall. The term "continuous structure that forms a wall", as used herein, is defined to mean a structure, uninterrupted by gaps, used as a barrier. Accordingly, the lower edge 64 is configured to prevent a flow of air from entering the intake vent 56 through the lower edge 64. That is, air cannot flow through the lower edge 64. Rather, air may enter the vent by flowing under the lower edge 64 and then up into the vent. In some embodiments, air may enter the vent by flowing over the lower edge 64 and down through louvers 78 as described in more detail below.

Referring now to FIGS. 2, 2A, and 2B, in each exemplary embodiment the intake vent 56 has a length L1 and a width W. In the illustrated embodiment, the length L1 is in a range or from about 12.0 inches to about 18.0 inches and the width W is in range of from about 36.0 inches to about 60.0 inches. Alternatively, the length L1 of the intake vent 56 can be less than about 12.0 inches or more than about 18.0 inches and the width W can be less than about 36.0 inches or more than about 60.0 inches.

In the exemplary embodiment illustrated by FIG. 2, the first portion 60 of the intake vent 56 has a length L2 and the second portion 62 of the intake vent 56 has a length L3. The lengths L2 and L3 are generally associated with a distance DS, that is the distance of a slot 108 positioned in the roof deck 38 as shown in FIG. 1. The slot 108 and the distance DS will be discussed in more detail below. In the embodiment illustrated in FIG. 2, the length L2 is in a range of from about 4.0 inches to about 9.0 inches and the length L3 is in a range of from about 3.0 to about 14.0 inches. Alternatively, the length L2 of the first portion can be less than about 4.0 inches or more than about 9.0 inches and the length L3 can be less than about 3.0 inches or more than about 14.0 inches.

In the exemplary embodiment illustrated by FIGS. 2A and 2B, the first portion 60 of the intake vent 56 has a length L2, the intermediate portion of the vent 56 has a length L4, and the second portion 62 of the intake vent 56 has a length L3. The lengths L2, L3, and L4 are generally associated with the distance DS. In the embodiment illustrated in FIGS. 2A and 2B, the lengths L2 and L4 are each in a range of from about 3.0 to about 12.0 inches and the length L3 is in a range of from about 2.0 inches to about 7.0. Alternatively, the lengths L2 and L4 of the first portion can be less than about 3.0 inches or more than about 12.0 inches each and the length L3 can be less than about 2.0 inches or more than about 12.0 inches.

Figure 14:
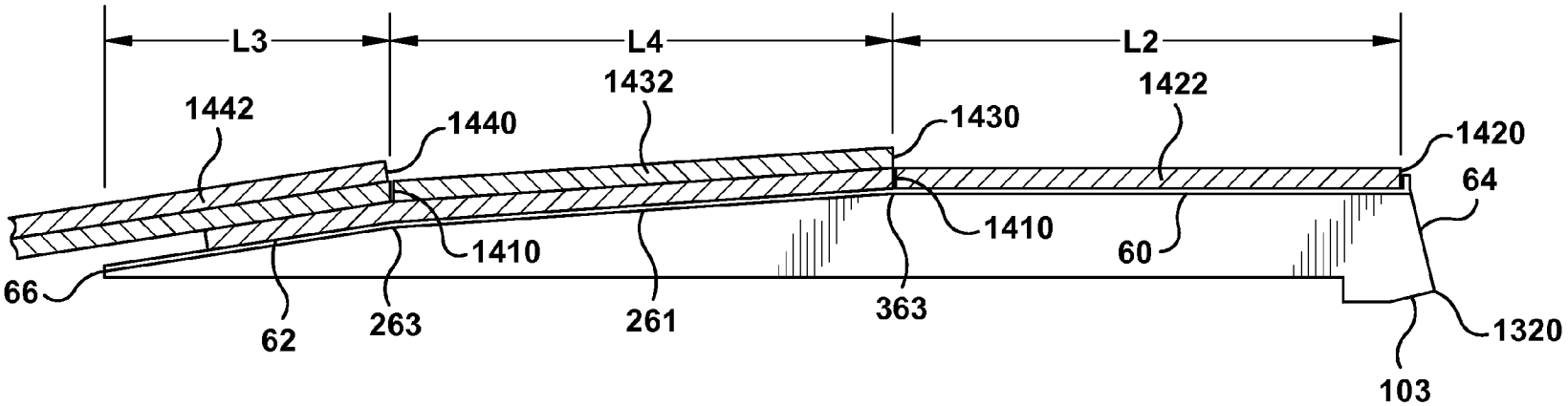
FIG. 14 illustrates an exemplary embodiment of shingles installed on a roof deck intake vent with exposed portions of the shingles aligned with profile breaks of the roof deck intake vent.

Referring to FIG. 14, in one exemplary embodiment the positions of the profile breaks 263, 363 between the sections 60, 261, and/or 62 are selected to correspond to align with features of a shingle. For example, the positions of the profile breaks 263, 363 may be selected to align with shingle surface breaks on a single layer and/or dimensional shingle. For example, the positions of the profile breaks may be selected to match the dimension of the portion of the shingle that is exposed. In FIG. 14, the line 1410 on each shingle indicates where the shingle transitions from a headlap portion to a tab portion. For example, in one exemplary embodiment shingles are installed such that 5⅝" of each shingle is exposed. In this embodiment, the length L2 of the first portion 60 of the intake vent 56 would be 5⅝" and the length L4 of the intermediate portion 261 would be 5⅝". In the example illustrated by FIG. 14, a lower edge 1420 of the lowermost shingle 1422 abuts the spoiler 72. A lower edge 1430 of the next shingle 1432 aligns with the break 363 between the first section 60 and the intermediate section 261. A lower edge 1440 of the next shingle 1442 aligns with the break 263 between the intermediate section 261 and the second section 62. The example illustrated by FIG. 14 shows single layer shingles to simplify the drawing. However, the concept is also applicable to aligning the breaks between the vent sections with shingle surface breaks and/or the edges of the exposed portions of multi-layer dimensional shingles. This concept is also applicable to vents with any number of sections and corresponding breaks. For example, the break between the portions 60, 62 of the vent illustrated by FIG. 2 may correspond to the dimension of the exposed portion of a shingle. The positions of profile breaks of shingles having more than three portions may be similarly selected.

Referring again to FIGS. 2 and 2A, in each exemplary embodiment the first portion 60 includes a plurality of fastening apertures 70*a*. Similarly, the second portion 62 includes a plurality of fastening apertures 70*b*. The fastening apertures 70*a* and 70*b*, are spaced apart along the length L and the width W of the intake vent 56. The fastening apertures 70*a* and 70*b* have an internal diameter DA. The internal diameter DA is oversized in relation to a fastener (not shown) extending through the fastening apertures 70*a* and 70*b*. The oversized internal diameter DA of the fastening apertures 70*a* and 70*b* is configured to allow a loose fit between the fastening apertures 70*a* and 70*b* and the fastener such that slight movement of the intake vent 56 relative to the fasteners is possible. In one embodiment, the fastener is a roofing nail. In other embodiments, the fastener can be other desired devices, including, but not limited to flat-headed screws. In the illustrated embodiment, the internal diameter DA of the fastening apertures 70*a* and 70*b* is approximately 0.12 inches corresponding roughly to a roofing nail having a 12 gauge shank diameter. Alternatively, the internal diameter DA can be more or less than approximately 0.12 inches corresponding to fasteners having other desired shank diameters such that slight movement of the intake vent 56 relative to the fasteners is possible.

Referring to FIG. 2, the fastening apertures 70*a* are separated by a distance LFA1. The distance LFA1 is configured to provide a sufficient quantity of fastening points to secure the intake vent 56 to the roof deck 38. In the illustrated embodiment, the distance LFA1 is in a range of from about 6.0 inches to about 16.0 inches. In other embodiments, the distance LFA1 can be less than about 6.0 inches or more than about 16.0 inches, sufficient to provide a sufficient quantity of fastening points to secure the intake vent 56 to the roof deck 38. Similarly, the fastening apertures 70*b* are separated by a distance LFA2. The distance LFA2 is configured to provide a sufficient quantity of fastening points to secure the intake vent 56 to the roof deck 38. In the illustrated embodiment, the distance LFA2 is in a range of from about 6.0 inches to about 16.0 inches. In other embodiments, the distance LFA2 can be less than about 6.0 inches or more than about 16.0 inches, sufficient to provide a sufficient quantity of fastening points to secure the intake vent 56 to the roof deck 38.

Referring again to FIGS. 2, 2A, 2B, in each illustrated embodiment the first portion 60 of the intake vent 56 includes an optional spoiler 72. The spoiler 72 extends from the top surface 60 *a* of the first portion 60 at the lower edge 64. In the illustrated embodiment, the spoiler 72 extends along the width W of the intake vent 56. Alternatively, the spoiler 72 can extend a desired distance that is shorter than the width W of the intake vent 56. In the illustrated embodiment, the spoiler 72 is a discontinuous structure, that is, the spoiler 72 includes a plurality of spaced apart slots 74. The slots are configured to allow water drainage from the top surface 60 *a* of the intake vent 56. However, it should be appreciated that in other embodiments, the spoiler 72 can be a continuous structure. Generally, the spoiler 72 is configured to assist in the flow of air over the shingles 40, thereby reducing potential uplift forces that may be acting on the shingles from natural forces, such as for example a hard wind. The spoiler 72 and the flow of air over the shingles 40 will be discussed in more detail below.

As shown in FIG. 2, optionally the intake vent 56 can include indicia 76 positioned on the top surfaces, 60*a* and 62*a* of the first and second portions, 60 and 62, of the intake vent 56. The indicia 76 can include a variety of desired messages, including, but not limited to product and company logos, promotional messages, installation instructions and product features. However, configuring the intake vent 56 to include indicia 76 is optional and not necessary to the use of the intake vent 56.

Referring again to FIG. 2, in one exemplary embodiment, optionally the top surfaces, 60*a* and 62*a*, of the intake vent 56 are configured to improve adhesion with an overlying ice and water barrier layer. This improved adhesion can be accomplished in a wide variety of different ways. For example, the top surface 60*a*, 62*a* may be textured, coated with an adhesion promoting substance, and/or provided with an adhesive. In the example illustrated by FIG. 2, optionally the top surfaces, 60*a* and 62*a*, of the intake vent 56 can be textured, as shown by reference character 61. The term "textured", as used herein, is defined to mean having a non-smooth surface characteristic. As will be discussed in more detail below, the textured surfaces can improve adhesion with an overlying ice and water barrier layer. The textured surfaces can have any desired structure or combination of structures, including the non-limiting examples of grooves, cross-hatchings or granulations. The textured surfaces can be formed by any desired forming process including the non-limiting examples of molding, machining, or manufacturing techniques including flame, corona, acid or plasma treatments.

In one exemplary embodiment, the top surface 60*a*, 62*a* may be coated with an adhesion promoting substance and/or be provided with an adhesive. The adhesive promoting substance and/or the adhesive may take a wide variety of different forms. For example, the an adhesive promoting substance may be any substance that an adhesive of the overlying ice and water barrier layer adheres to better than the underlying material of the intake vent. For example, the adhesive may be any substance that adheres well with an adhesive of the overlying ice and water barrier layer and/or that adheres well to the material of the overlying ice and water barrier layer. Examples of suitable adhesives to provide on the top surface 60*a* and/or 60*b* include, but are not limited to asphalt, pressure sensitive adhesives, heat activated adhesives, two-part reactive adhesives (with one part provided on the top surfaces 60*a*, 60*b* and the second part provided on the overlying ice and water barrier layer), and the like. Any known adhesive system may be used.

Referring again to FIGS. 2, 2A, and 2B, in each embodiment the intake vent 56 includes a plurality of louvers 78. In the embodiment shown in FIG. 1, the louvers 78 are covered by the second ice and water barrier layer 68 and by shingles 40. However, in other embodiments to be discussed below, the louvers 78 facilitate a flow of air external to the building to enter the roof structure through a slot formed in the roof deck and flow freely up the rafters and into the attic. In the illustrated embodiments, the louvers 78 are arranged in a column and row configuration. In the embodiment illustrated by FIG. 2, the louvers comprise a single column and a plurality of rows extending substantially along the width W of the intake vent 56. In the embodiment illustrated by FIG. 2A, the louvers comprises a multiple columns and a plurality of rows extending substantially along the width W of the intake vent 56. In other embodiments, the louvers 78 can be arranged in other desired configurations. As shown in FIGS. 2 and 2A, the louvers 78 are positioned to be substantially adjacent the spoiler 72. In other embodiments, the louvers 78 can be positioned in other desired locations sufficient to allow the flow of air external to the building to enter the roof structure through a slot formed in the roof deck and flow freely up the rafters and into the attic.

In the FIG. 2 embodiment, the louvers 78 have a rectangular shape. In the FIG. 2A embodiment, the louvers 78 have a square shape. In other embodiments, the louvers 78 can have other shapes, including, but not limited to round or hexagonal shapes sufficient to allow the flow of air external to the building to enter the roof structure through a slot formed in the roof deck and flow freely up the rafters and into the attic. In the embodiment illustrated by FIG. 2, there are a single row of louvers 78. In other embodiments, multiple rows of optionally smaller louvers can be provided. The multiple rows result in a mesh configuration. The smaller inlet openings provided by the mesh configuration reduces the collection of roof debris from water run-off for mid-roof installations (See FIG. 7 for the mid-roof installation).

Referring again to FIGS. 2 and 2B, in the illustrated embodiments, the top surface 62*a* of the second portion 62 and the bottom edge 77 of the second portion 62 form a second portion angle $\alpha$. The second portion angle $\alpha$ is configured to provide a substantially smooth transition for overlapping shingles 40 transitioning between the roof deck 38 and the intake vent 56. In the illustrated embodiment, the second portion angle $\alpha$ is in a range of from about 5.0° to about 30.0°, for example from about 5.0° to about 15°, such as about 7.5° to about 12.5°. In one exemplary embodiment, the illustrated second portion angle $\alpha$ is about 7.5°. In other embodiments, the second portion angle $\alpha$ can be less than about 5.0° or more than about 30.0° sufficient to provide a substantially smooth transition for overlapping shingles 40 transitioning between the roof deck 38 and the intake vent 56.

Referring to FIGS. 2 and 2B, in the two illustrated exemplary embodiments the first portion 60 of the intake vent 56 has a thickness T1. In the illustrated embodiment, the thickness T1 is about 1.0 inch. Alternatively, the thickness T1 can be more or less than about 1.0 inch. In the embodiments illustrated by FIGS. 2 and 2A, the thickness T1 is uniform across the length L2 of the first portion 60. However in other embodiments, the thickness T1 can vary across the length L2 of the first portion 60.

Referring now to FIG. 3 and FIG. 3A, the bottom surfaces, 60 *b* and 62 *b*, of the first and second wall portions, 60 and 62, are illustrated. FIG. 3A also shows the bottom surface 261 *b* of the intermediate wall portion 261. In each illustrated embodiment, the plurality of fastening apertures 70 *a*, spaced apart in the first portion 60, are defined by a plurality of first nailing bosses 80. Similarly, in the FIG. 3 embodiment the plurality of fastening apertures 70 *b*, spaced apart in the second portion 62, are defined by a plurality of second nailing bosses 82. Generally, the first nailing bosses 80 are positioned near the lower edge 64 of the first portion 60 and the second nailing bosses 82 are positioned near the upper edge 66 of the second portion 62, although such is not required.

Figure 4:
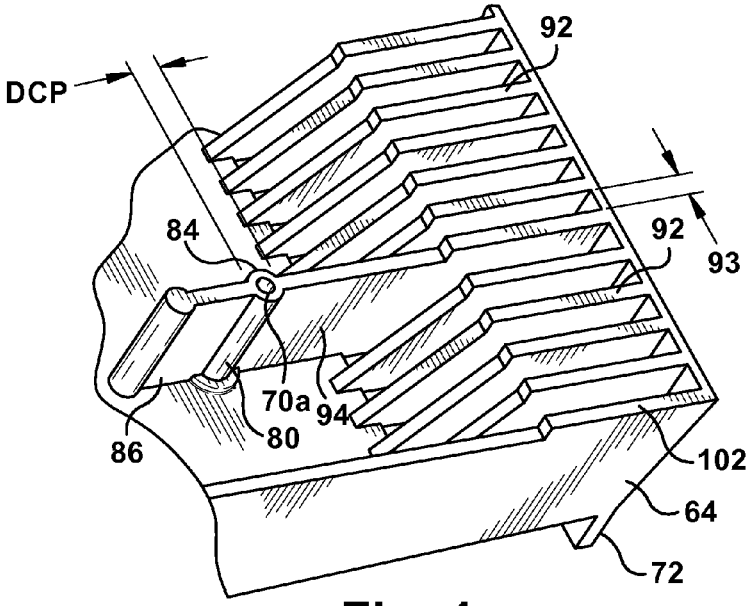
FIG. 4 is a perspective view of a portion of the intake vent of FIG. 3 illustrating a first nailing boss.
Figure 4A:
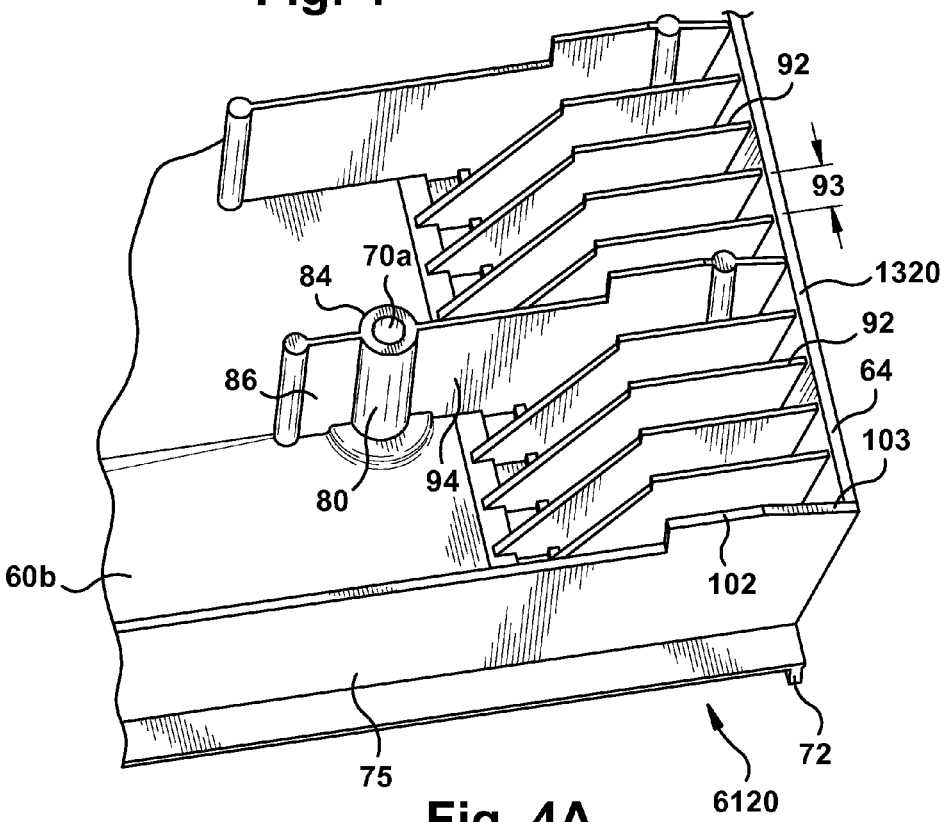
FIG. 4A is a perspective view of a portion of the intake vent of FIG. 3A illustrating a first nailing boss.

The first nailing bosses 80 include a cylindrical portion 84 supported by a nailing baffle 86, as shown in FIGS. 4 and 4A. Similarly, the second nailing bosses 82 include a cylindrical portion 88 supported by a nailing baffle 90, as shown in FIG. 3. The cylindrical portions, 84 and 88, are configured to extend from the bottom surfaces, 60*b* and 62*b*, of the first and second portions, 60 and 62, to the roof deck 38, thereby providing a solid support surface for seating the fastener. The nailing baffles, 86 and 90, are configured to support the cylindrical portions, 84 and 88. Any desired number of nailing bosses, 80 and 82, can be used.

The cylindrical portions, 84 and 88, have a diameter DCP. In the illustrated embodiment, the diameter DCP of the cylindrical portions, 84 and 88, is approximately 0.31 inches. Alternatively, the diameter DCP of the cylindrical portions, 84 and 88, can be more or less than approximately 0.31 inches.

Referring again to FIG. 3, the first portion 60 of the intake vent 56 includes a plurality of lower edge baffles 92, intermediate baffles 94 and interior baffles 96. In the FIG. 3 embodiment, the lower edge baffles 92, intermediate baffles 94 and interior baffles 96 extend in a direction that is generally perpendicular to the lower edge 64 of the first portion of the intake vent 56. The lower edge baffles 92 and the intermediate baffles 94 are configured to provide structural support to the lower edge 64, as well as providing structural support to the areas of the first portion 60 in which the louvers 78 are positioned. The lower edge baffles 92 and the intermediate baffles 94 extend different lengths from the lower edge 64. The lower edge baffles 92 have a length LB1. In the illustrated embodiment, the length LB1 is in a range of from about 0.5 inches to about 2.0 inches. However, in other embodiments, the length LB1 can be less than about 0.5 inches or more than about 2.0 inches sufficient to provide structural support to the lower edge 64 and the first portion 60 of the intake vent 56. The intermediate baffles 94 have a length LB2. In the illustrated embodiment, the length LB2 is in a range of from about 1.5 inches to about 4.0 inches. In other embodiments, the length LB2 can be less than about 1.5 inches or more than about 4.0 inches sufficient to provide structural support to the lower edge 64 and the first portion 60 of the intake vent 56. In the illustrated embodiment, all of the lower edge baffles 92 have the same length LB1. In other embodiments, the lower edge baffles 92 can be varying lengths. Similarly, it is also within the contemplation of this invention that the intermediate baffles 94 can have varying lengths.

Referring again to the embodiment illustrated in FIG. 3, the interior baffles 96 are oriented in a direction that is generally perpendicular to lower edge 64 and extend in a line along the length L1 of the intake vent 56. The interior baffles 96 are configured to provide structural support to the first portion 60. However, in other embodiments the interior baffles 96 can have different orientations relative to the lower edge 64 and configurations sufficient to provide structural support to the first portion 60. For example, in the embodiment illustrated by FIG. 3B, baffles 396 are oriented in an angled direction relative to the lower edge 64 and comprise multiple segments. The baffles 396 may have two legs that meet to form a "V" shape.

In the illustrated embodiment illustrated by FIG. 3, the interior baffles 96 are straight and have a length LB3. In the illustrated embodiment, the length LB3 is in a range of about 0.5 inches to about 3.0 inches. Alternatively, the length LB3 can be less than about 0.5 inches or more than about 3.0 inches sufficient to provide structural support to the first portion 60. Adjacent interior baffles 96 are separated by a distance DB. In the embodiment illustrated by FIG. 3, the distance DB is in a range of from about 1.0 inch to about 4.0 inches. However, in other embodiments, the distance DB can be less than about 1.0 inch or more than about 4.0 inches sufficient configured to provide structural support to the first portion 60. While the interior baffles 96 in the illustrated embodiment are all shown to have the same length LB3, it is within the contemplation of this invention that the interior baffles 96 can have varying lengths.

Referring again to FIGS. 3 and 3A, the second portion 62 of the intake vent 56 includes a plurality of upper edge baffles 98. In the FIG. 3A embodiment, the upper edge baffles 98 extend into the intermediate portion 261. The upper lower edge baffles 98 extend in a direction that is generally perpendicular to the upper edge 66 of the second portion of the intake vent 56. The upper edge baffles 98 are configured to provide structural support to the areas of the second portion 62 in which the nailing bosses 82 are positioned. The upper edge baffles 98 extend a length LB4 from the upper edge 66. In the illustrated embodiment, the length LB4 is in a range of about 3.0 inches to about 6.0 inches. Alternatively the length LB4 can be less than about 3.0 inches or more than about 6.0 inches sufficient configured to provide structural support to the areas of the second portion 62 in which the nailing bosses 82 are positioned. In the illustrated embodiment, all of the upper edge baffles 98 have the same length LB4. In other embodiments, the upper edge baffles 98 can be varying lengths.

Referring again to FIGS. 3 and 3A, in each illustrated embodiment a plurality of spaced apart optional continuous baffles 99 extend from the lower edge 64 to the upper edge 66. The continuous baffles 99 are configured to substantially prevent a cross-flow of air within an intake vent 56 or between adjacent intake vents 56. In the illustrated embodiment, the continuous baffles 99 are spaced apart a distance in a range of from about 6.0 inches to about 16.0 inches. In other embodiments, the continuous baffles 99 can be spaced apart a distance of less than about 6.0 inches or more than about 16.0 inches.

While the embodiment shown in FIG. 3 has lower edge baffles 92, intermediate baffles 94, interior baffles 96, upper edge baffles 98, nailing baffles 86 and 90 as straight members that are oriented to be substantially perpendicular to the lower edge 64, it is within the contemplation of this invention that the lower edge baffles 92, intermediate baffles 94, interior baffles 96, upper edge baffles 98, nailing baffles 86 and 90 could be curved members or have curved portions and also could be oriented at any desired angle to the lower edge 64. For example, the baffles 396 are one of the many other baffle configurations that are possible.

Referring again to FIG. 3 and FIG. 2B, in each illustrated embodiment the material forming the first and second portions, 60 and 62, has a thickness T2. The thickness T2 is configured to provide the intake vent 56 with a desired rigidity. In the illustrated embodiment, the thickness T2 is in a range of from about 0.03 inches to about 0.10 inches. In other embodiments, the thickness T2 can be less than about 0.03 inches or more than about 0.10 inches, sufficient to provide the intake vent 56 with a desired rigidity.

While the material forming the first and second portions, 60 and 62, has been described as having the thickness T2, the upper edge 66 of the second portion 62 has a thickness T3, which in the illustrated embodiment is different from the thickness T2. The thickness T3 is configured to provide structural support to the upper edge 66. In the illustrated embodiment, the thickness T3 is in a range of from about 0.10 inches to about 0.20 inches. It should be appreciated that in other embodiments, the thickness T3 forming the upper edge 66 can be less than about 0.06 inches or more than about 0.20 inches. In one exemplary embodiment, the thickness T3 is greater than the thickness T2. For example, the thickness T3 may be 1.5 to 5 times the thickness of T2, such as about twice the thickness of T2.

Figure 5:
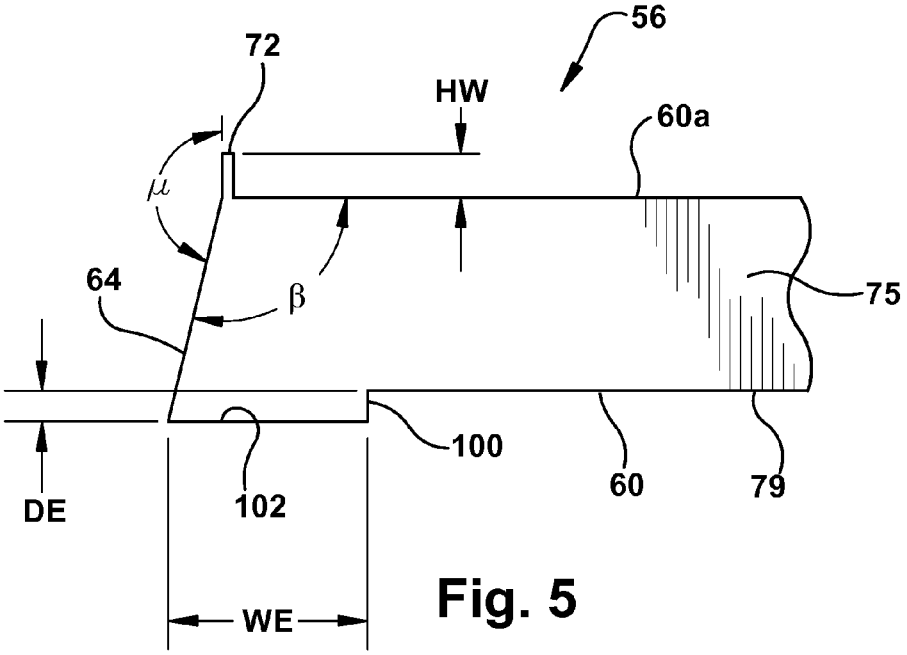
FIG. 5 is a side view, in elevation, of a portion of the intake vent of FIG. 2 illustrating a spoiler, an upper edge and an extension.
Figure 5A:
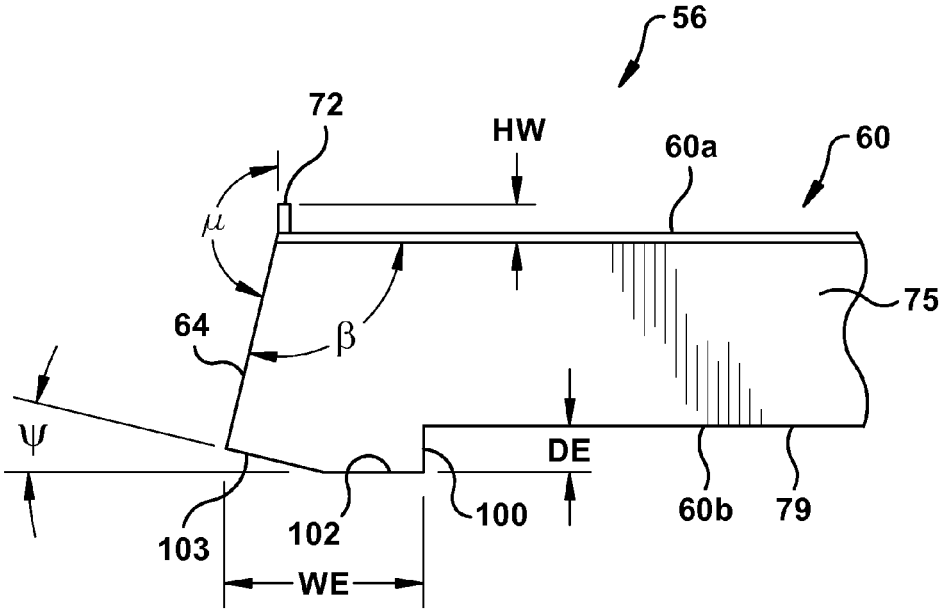
FIG. 5A is a side view, in elevation, of a portion of the intake vent of FIG. 2A illustrating a spoiler, an upper edge and an extension.

Referring now to FIGS. 5 and 5A, in each of the illustrated embodiments the extension portion of the second side wall 75 (and the extension portion of the first side wall 73, not shown in FIGS. 5 and 5A) includes an extension 100. As will be discussed in more detail below, the extension 100 forms a bottom air intake for the intake vent 56. Further, the extension 100 is configured to allow a portion of the installed intake vent 56 to be positioned vertically below a plane defining the roof deck while not impeding the action of the adjacent drip edge 50. The extension 100 has a width WE and extends a distance DE from the bottom surface 60 *b* of the first portion 60. In the illustrated embodiment, the width WE is in a range of from about 0.25 inches to about 1.25 inches and the distance DE is in a range of from about 0.10 inches to about 0.40 inches. However, it should be appreciated that in other embodiments, the width WE can be less than about 0.25 inches or more than about 1.25 inches and the distance DE can be less than about 0.10 inches or more than about 0.40 inches.

Referring again to FIGS. 5 and 5A, in each illustrated embodiment the lower edge 64 of the first portion 60 forms an edge angle β with the top surface 60 *a* of the first portion 60. The edge angle β is configured such that the lower edge 64 of the intake vent 56 is in a substantially vertical orientation when the intake vent 56 is in an installed position on a roof deck, as shown in FIG. 1. For example, the edge angle β may equal the slope of the roof plus 90 degrees. The term "substantially vertical orientation", as used herein, is defined to mean an angle with a horizontal line in a range of from about 80° to about 110°. In the illustrated embodiment, the edge angle β is in a range of from about 115.0° to about 130°. However, in other embodiments, the edge angle β can be less than about 115.0° or more than about 130°.

Referring to FIGS. 4 and 5, the extension 100 has a lower surface 102. In the Figure the lower surface 102 of the extension 100 is interrupted by portions of the lower edge baffles 92, intermediate baffles 94, cross baffles 99, and nailing baffles 86, thereby forming the bottom air intake for the intake vent 56. As such, the vent 56 has a configuration where the bottom of the vent is completely open (i.e. there is no bottom wall) and the bottom air intake is formed by projections that extend downward from the bottom of the top wall(s) of the vent. In the illustrated embodiments, the bottom air intake is formed by projections that extend downward from the bottom 60 *b* of the first portion 60 of the vent 56 In the edge installations (See FIGS. 1 and 12), the top intake openings 78 are covered by the shingles. In the mid-roof installation, the top intake openings 78 are not covered by the shingles in an exemplary embodiment. In an exemplary embodiment, a spacing 93 between the baffles is less than or equal to 0.25 inches. It can be seen that the lower surface 102 of the extension 100 is separated from the top surface 60 *a* of the first portion 60 by the lower edge 64.

Referring again to the embodiment shown in FIG. 5, a plane formed by the top surface 60*a* of the first portion 60 and a plane formed by the lower surface 102 of the extension 100 have a substantially parallel configuration. Alternatively, a plane formed by the top surface 60*a* of the first portion 60 and a plane formed by the lower surface 102 of the extension 100 can have substantially non-parallel configurations. For example, in the FIG. 5A embodiment, a forward portion 103 of the lower surface 102 forms an angle Ψ with the remainder of the lower surface 102, and thus with the top surface 60*a*.

As discussed in more detail below, the lower surface 102 of the extension 100 is sized to provide a desired net free vent area. While the embodiment illustrated by FIG. 5 has the lower surface 102 of the extension 100 as having a rectangular shape, it should be appreciated that in other embodiments, the lower surface 102 of the extension 100 can have other shapes, such as the non-limiting example of a triangular. The embodiment illustrated by FIG. 5A illustrates one of the many possible different shapes that the lower surface 102 can have.

To work most efficiently, an attic ventilation system must balance the ventilating requirement (called the total net free area) between the intake vents and the exhaust vents. In certain calculations, the total net free area is calculated as the attic square footage divided by 150 (certain building codes call for the total net free ventilating area to be not less than $1/150^{th}$ of the area of the space to be ventilated). For optimum ventilating performance, the resulting total net free area is then balanced as 50% for the intake and 50% for the exhaust. The lower surface 102 of the extension 100 is then sized accordingly. In the illustrated embodiment, the lower surface 102 of the extension 100 provides a net free vent area of 10 square inches per lineal foot. Assuming that a building has intake vents 56 installed on two roof decks 38, then the total net free vent area of the intake vents 56 is 20 square inches per lineal foot, which corresponds to a total net free vent area of an exhaust of 20 square inches per lineal foot.

Referring now to FIGS. 5 and 5A, in the two illustrated exemplary embodiments the first portion 60 of the intake vent 56 has the spoiler 72. In other embodiments, the spoiler may be omitted. The spoiler 72 extends in an upward direction from the top surface 60 *a* of the first portion 60. The spoiler 72 has a height HW. In the illustrated embodiments, the height HW is in a range of about 0.12 inches to about 0.50 inches. In other embodiments, the height HW can be less than about 0.12 inches or more than about 0.50 inches, sufficient to assist in the flow of air over the shingles, thereby reducing potential uplift forces that may be acting on the shingles. The spoiler 72 forms a spoiler angle μ with the lower edge 64. In the illustrated embodiment, the spoiler angle μ is in a range of from about 120° to about 160°. In other embodiments, the spoiler angle μ can be less than about 120° or more than about 160°, sufficient to assist in the flow of air over the shingles.

Figure 6:
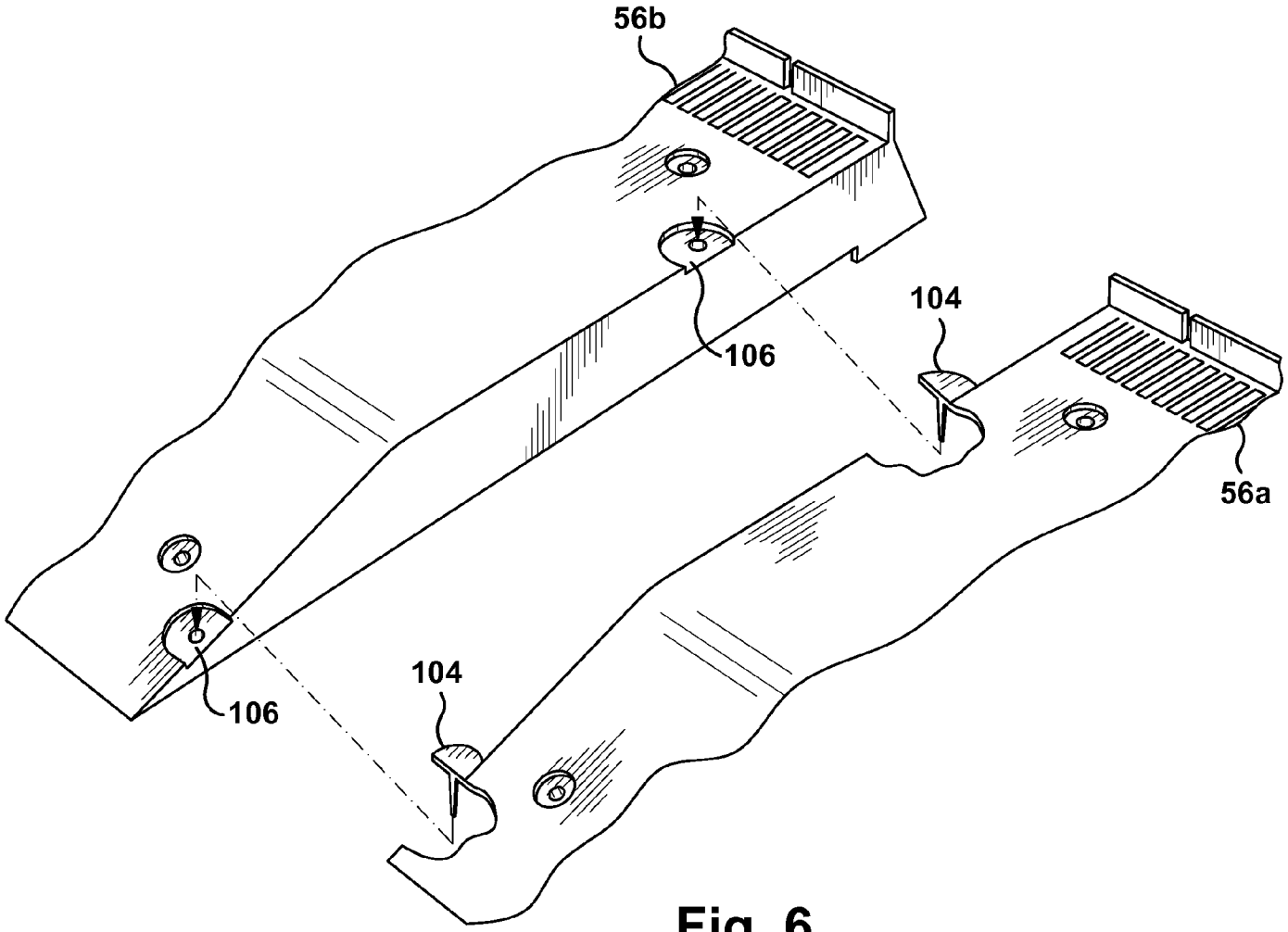
FIG. 6 is a partial perspective view of portions of two intakes vent of FIG. 1 illustrating attachment fixtures and attachment receptacles.

Referring now to FIG. 6, a plurality of attachment fixtures 104 are connected to one end of an intake vent 56*a*. A plurality of corresponding attachment receptacles 106 are positioned at the opposite end of an intake vent 56*b*. As shown in FIG. 6, the intake vent 56*a* is connected to the intake vent 56*b* by connecting the attachment fixtures 104 of the intake vent 56*a* to the corresponding attachment receptacles 106 of intake vent 56*b*. The connection between the intake vents, 56*a* and 56*b*, is configured to provide a quick, easy and gapless connection that can be accomplished without the use of special tools. In the illustrated embodiment, the attachment fixtures 104 are pins and the attachment receptacles 106 are corresponding apertures. Alternatively, other desired structures, including, but not limited to dovetail joints, tongue and groove joints and tabs and slots, can be used.

Figure 6A:
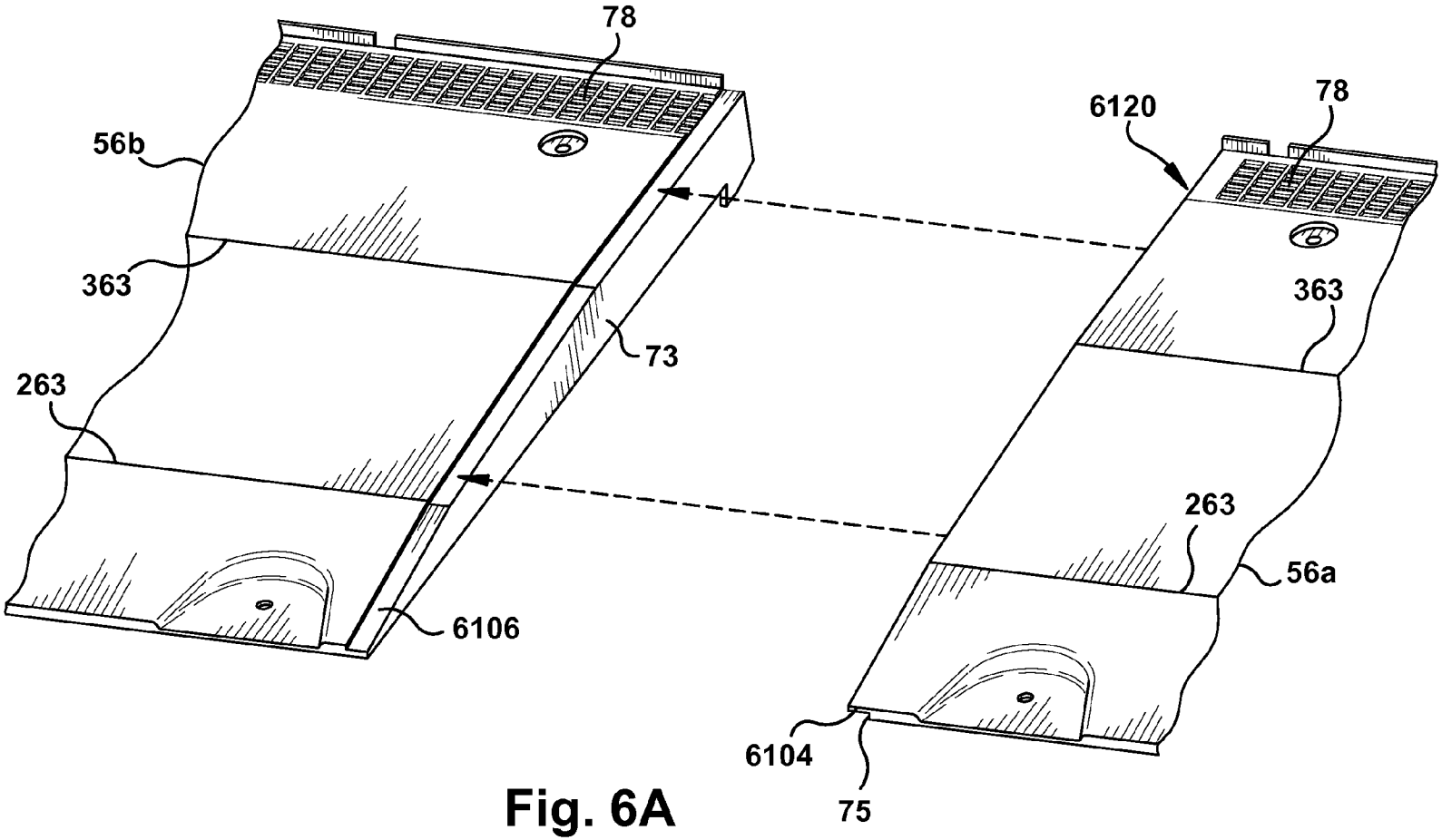
FIG. 6A is a partial perspective view of portions of two intake vents of FIG. 2A illustrating attachment with shiplap joining structures.

Referring now to FIG. 6A, intake vents 56*a*, 56*b* are assembled in a shiplap configuration. In the illustrated example, the vent 56*a* includes an extension 6104 and the vent 56*b* includes a recess 6106. As shown in FIG. 6A, the intake vent 56*a* and the intake vent 56*b* are assembled in a water-shedding manner by positioning the extension 6104 of the intake vent 56*a* in/on the recess receptacles 6106 of intake vent 56*b*. The shiplap configuration between the intake vents, 56*a* and 56*b* is quick, easy and gapless and allows for some relative positioning between the vents 56*a*, 56*b*. For example, if there is variation in the eave line of the roof, the roof deck is not straight, and/or an intake vent is not precisely aligned on the roof deck, the shiplap configuration allows for one intake vent to be angularly adjusted relative to the other while maintaining the waters-shedding shiplap between the vents. Further, the shiplap configuration allows for thermal expansion/contraction and/or roof deck movement that may occur, while maintaining the waters-shedding between the vents. Further, a male end 6120 (i.e. the end that includes the extension 6104) may be cut during installation of a plurality of vent sections to form a vent assembly having any desired width. The cut end of the vent is assembled over the recess 6106 and the shiplap is still formed to achieve the desired water-shedding.

Referring now to FIG. 1, the intake vent 56 of any of the disclosed embodiments is installed in the following steps. First, the lower portion of the roof deck 38, having the first ice and water barrier layer 41, is exposed. Next, a slot 108 is formed in the roof deck 38 and in the first ice and water barrier layer 41. The slot 108 extends substantially the length of the roof deck 38 and is oriented in the roof deck 38 to be substantially parallel to the lower edge of the roof deck 38. The slot 108 has a slot width SW. In the illustrated embodiment, the slot width SW is in a range of from about 1.0 inch to about 3.0 inches. Alternatively, the width SW of the slot 108 can be less than about 1.0 inch or more than about 3.0 inches.

The slot 108 is formed a distance DS from the front edge of the drip edge 50. In the illustrated embodiment, the distance DS is in a range of from about 4.0 inches to about 8.0 inches. In other embodiments, the distance DS can be less than about 4.0 inches or more than about 8.0 inches. After the slot 108 is formed, the intake vent 56 is positioned on the first ice and water barrier layer 41, such that the extension 100 abuts the drip edge 50. In this position, the lower surfaces, 77, 79, of the intake vent 56 are mounted such as to be flush with the first ice and water barrier layer 41, and the slot 108 in the roof deck 38 substantially aligns with the transition point 63 of the top surfaces, 60*a* and 60*b*. Next, the intake vent 56 is fastened to the roof deck 38, as discussed above. Subsequent intake vents 56 are connected to the installed intake vents 56, as discussed above, until the lower roof deck 38 is completely covered. Next, the second ice and water barrier layer 68 is installed over the intake vent 56 such that the second ice and water barrier layer 68 extends over the louvers 78 and abuts the spoiler 72. Finally, courses of shingles 40, including a course of starter shingles 43 are installed, in an overlapping manner, over the installed intake vents 56. In the illustrated embodiment, the shingles 40 are installed over the intake vents 56 using conventional fasteners, such as for example, nails. Alternatively, other desired methods, including, but not limited to staples and adhesives, can be used to install the shingles 40 over the intake vents 56. The illustrated configuration of the intake vent 56 and the various roofing components allows the flow of air to enter the extension 100 and travel through the intake vent 56, up the rafters 36 and into the attic 42 as shown by arrows A.

As discussed above, the intake vent 56 is configured as a conduit, to allow a flow of air external to the building to enter the roof structure 34 through a slot formed in the roof deck 38 and flow freely up the rafters 36 and into the attic 42. This function is performed in an outdoor environment, with all of the elements of the weather. Accordingly, the intake vent 56 is made of a material sufficient to provide both structural and weatherability features. In the illustrated embodiment, the intake vent 56 is made of a polypropylene material. Alternatively, the intake vent 56 can be made of other polymeric materials sufficient to provide both structural and weatherability features. In still other embodiments, the intake vent 10 can be made of other desired materials or a combination of desired materials.

As shown in FIGS. 1-6 and discussed above, the intake vent 56 provides significant benefits, although all of the benefits may not be present in all circumstances. First, as shown in FIG. 1, air entering the intake vent 56 enters through the extension 100. In an installed position, the extension 100 is located such that the air enters from below the lowest point of the lower edge 64. Accordingly, wind driven rain is blocked from entering the intake vent 56. Second, as further shown in FIG. 1, the intake vent 56 is installed over an existing drip edge 50 and existing gutter 48. Advantageously, the intake vent 56 does not require the removal and reinstallation of the drip edge 50 and gutter 48. Third, the intake vent 56 can be used in those situations where the building does or does not have a soffit. Finally, the dimensions of the extension 100 can be changed to provide an intake vent having a different net free vent area.

While the embodiment of the intake vent 56 illustrated in FIGS. 1-6 is described above as being positioned at the lower edge of the roof deck 38, it should be appreciated that in other embodiments, the intake vent 56 can be positioned in other areas of the roof deck 38 and configured as a conduit, to allow a flow of air external to the building to enter the roof structure 34 through a slot formed in the roof deck 38 and flow freely up the rafters 36 and into the attic 42.

Figure 7:
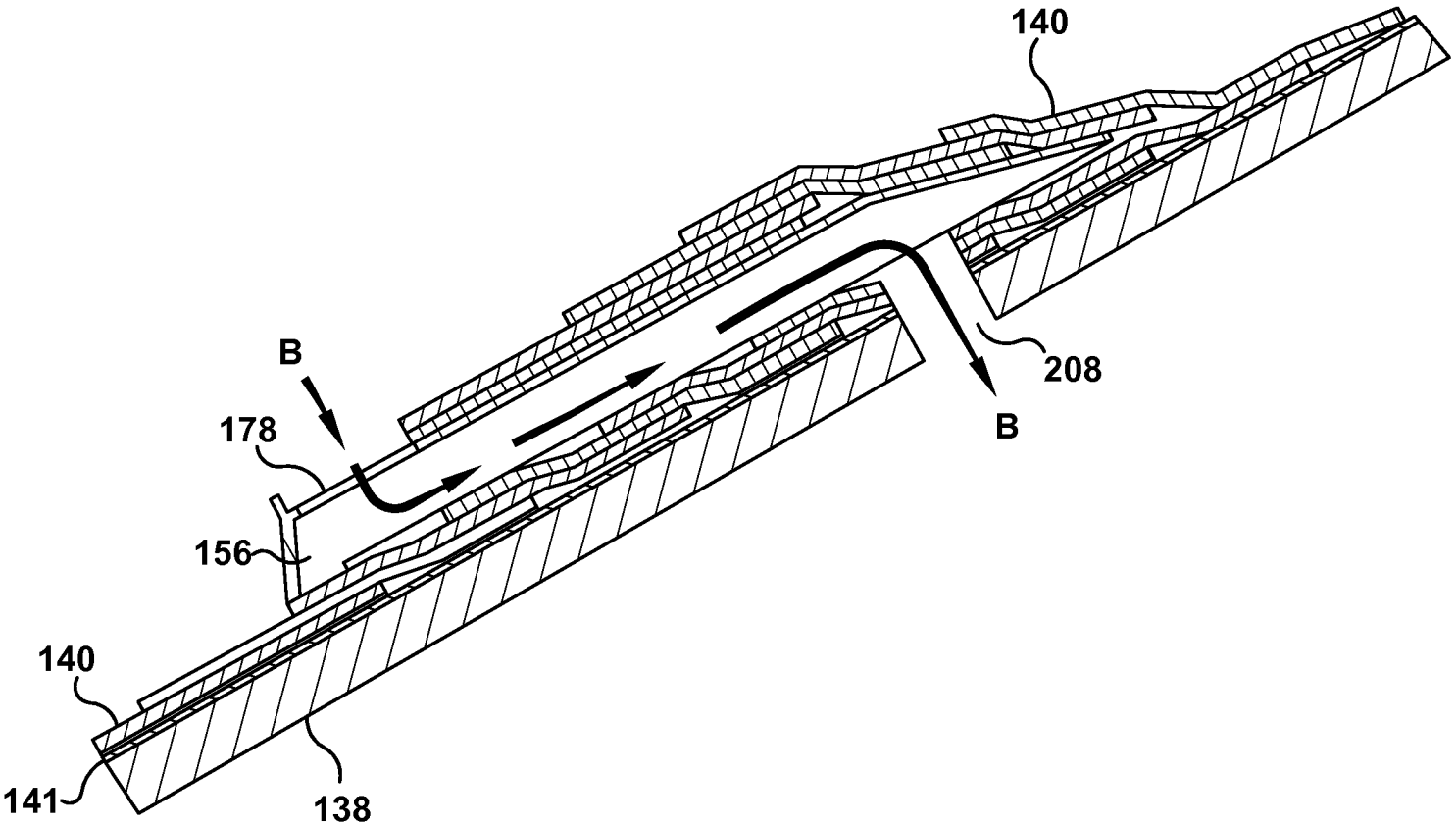
FIG. 7 is a side view, in elevation, of a portion of a building structure incorporating a another embodiment of a roof deck intake vent.
Figure 7A:
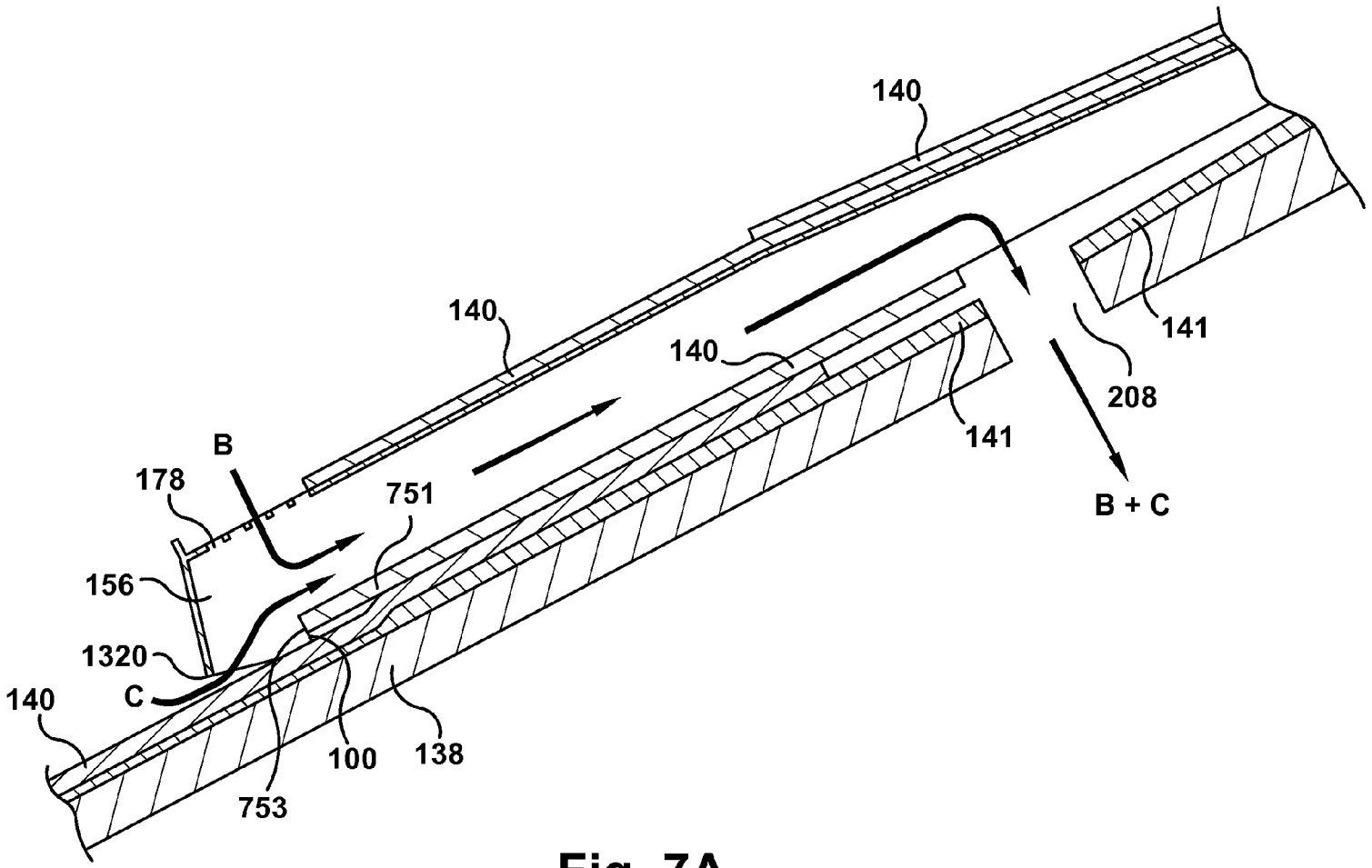
FIG. 7A is a side view, in elevation, of a portion of a building structure incorporating a another embodiment of a roof deck intake vent.

Referring now to FIGS. 7 and 7A, additional embodiments of an intake vent are shown generally at 156. In the embodiments illustrated by FIGS. 7 and 7A, the intake vent 156 illustrated is spaced apart a distance from the lower edge of the roof deck 38, A plurality of shingles 140 and a first ice and water barrier layer 141 are installed on a roof deck 138 as discussed above. In the illustrated embodiment, the shingles 140, first ice and water barrier layer 141 and roof deck 138 are the same as the shingles 40, first ice and water barrier layer 41 and roof deck 38 illustrated in FIG. 1 and discussed above. However, in other embodiments, the shingles 140, first ice and water barrier layer 141 and roof deck 138 can be different from the shingles 40, first ice and water barrier layer 41 and roof deck 38. The roof deck includes a slot 208, formed in the roof deck 138 as discussed above for the slot 108. The slot 208 can be positioned on the roof deck 138 at any vertical distance from the lower edge of the roof deck 138. The intake vent 156 is positioned over the shingles 140 and over the slot 208 and fastened to the roof deck 138 as discussed above. In the example illustrated by FIG. 7A, the extension 100 engages an edge 753 of a tab portion 751 of a shingle 140. In the illustrated embodiment, the intake vent 156 is the same as the intake vent 56 illustrated in FIG. 1 and discussed above. However, in other embodiments, the intake vent 156 can be different from the intake vent 56.

Courses of shingles 140 are installed, in an overlapping manner, over the installed intake vents 156 such that the louvers 178 are exposed. Installed in this configuration, the intake vent 56 and the various roofing components allows the flow of air to enter the louvers 178 and travel through the intake vent 156, up the rafters (not shown) and into the attic (not shown) as illustrated by arrows B in FIG. 7. In the example illustrated by FIG. 7A, the lower front edge 1320 is spaced apart from the shingles 140, so that air can enter the intake vent 156 between the lower front edge 1320 and the shingles 140. As such, in the FIG. 7A embodiment, the flow of air enters both the louvers 178 and the space between the lower front edge 1320 and the shingles 140 and travels through the intake vent 156, up the rafters (not shown) and into the attic (not shown) as illustrated by arrows C.

Figure 8:
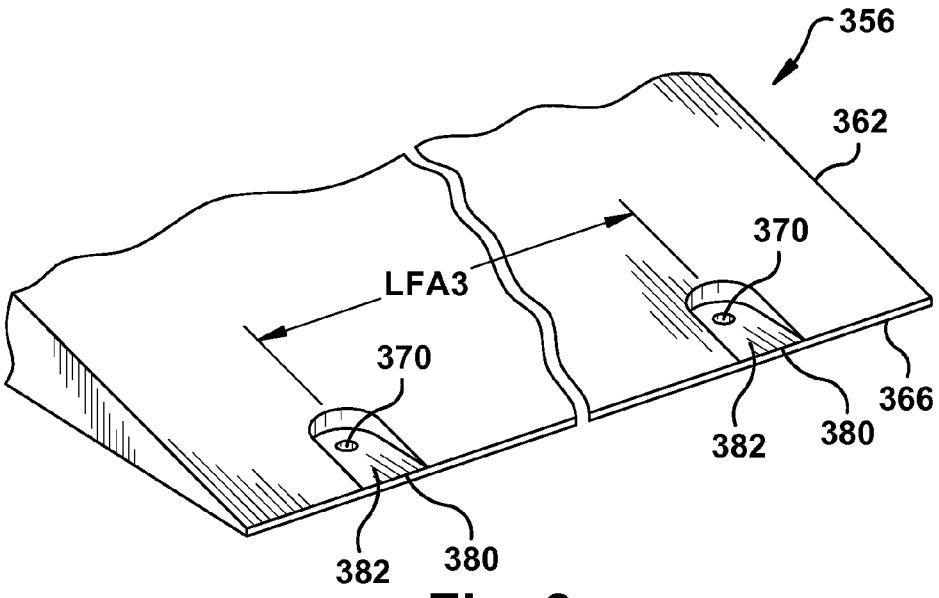
FIG. 8 is a perspective view of another embodiment of a roof deck intake vent.

Referring again to FIGS. 2 and 3, the intake vent 56 was described above as having fastening apertures 70*b* and second nailing bosses 82 located in the second portion 62. The fastening apertures 70*b* and second nailing bosses 82 are configured to provide a solid support surface for seating fasteners. Alternatively, the second portion 62 of the intake vent 56 can have other structures configured to provide a solid support surface for seating a fastener. Referring first to FIG. 8, another embodiment of an intake vent is shown at 356. The intake vent 356 includes a second portion 362. The second portion 362 includes a plurality of nailing bosses 380, each having at least one nailing aperture 370. The nailing bosses 380 include a base 382 that is configured to seat in a flat orientation against a roof deck (not shown). The base 382 is configured to provide a solid support surface for seating a fastener. The fastening apertures 370 are separated by a distance LFA3. The distance LFA3 is configured to provide a sufficient quantity of fastening points to secure the intake vent 356 to the roof deck (not shown). In the illustrated embodiment, the distance LFA3 is in a range of from about 6.0 inches to about 16.0 inches. In other embodiments, the distance LFA3 can be less than about 6.0 inches or more than about 16.0 inches, sufficient to provide a sufficient quantity of fastening points to secure the intake vent 356 to the roof deck.

While the bases 382 of the nailing bosses 380 are shown as extending from the upper edge 366 of the second portion 362, in other embodiments, the nailing bosses 380 can be positioned in any desired location of the intake vent 356, including the first portion (not shown).

Figure 9:
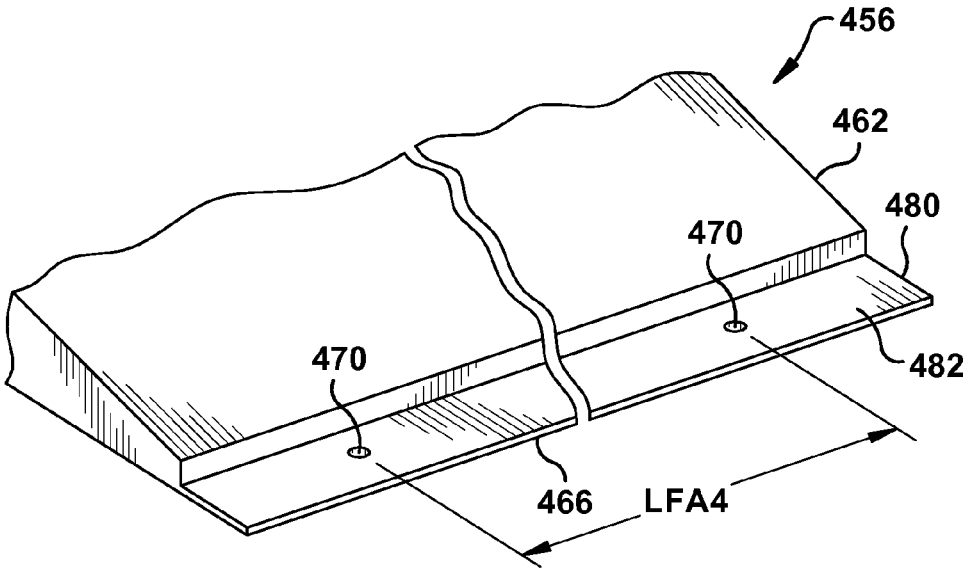
FIG. 9 is a perspective view of another embodiment of a roof deck intake vent.

Referring now to FIG. 9, another embodiment of an intake vent is shown at 456. The intake vent 456 includes a second portion 462. The second portion 462 includes a nailing boss 480. The nailing boss 480 includes a base 482 that is configured to seat in a flat orientation against a roof deck (not shown) and a plurality of nailing apertures 470. The fastening apertures 470 are separated by a distance LFA4. The distance LFA4 is configured to provide a sufficient quantity of fastening points to secure the intake vent 456 to the roof deck (not shown). In the illustrated embodiment, the distance LFA4 is in a range of from about 6.0 inches to about 16.0 inches. In other embodiments, the distance LFA4 can be less than about 6.0 inches or more than about 16.0 inches, sufficient to provide a sufficient quantity of fastening points to secure the intake vent 456 to the roof deck.

Referring again to FIG. 9, the base 482 is configured to provide a solid support surface for seating a fastener. While the embodiment of the intake vent 456 shown in FIG. 9 illustrates a lone nailing boss 470, it should be appreciated that in other embodiments, more than one nailing boss 470 can be used or no nailing bosses may be needed. While the base 482 of the nailing boss 470 is shown as extending from the upper edge 466 of the second portion 462, in other embodiments, the nailing bosses 470 can be positioned in any desired location of the intake vent 456, including the first portion (not shown). In another exemplary embodiment, the base is a solid strip with no holes. In this embodiment, nails can be driven through the base 482 at any location.

Figure 10:
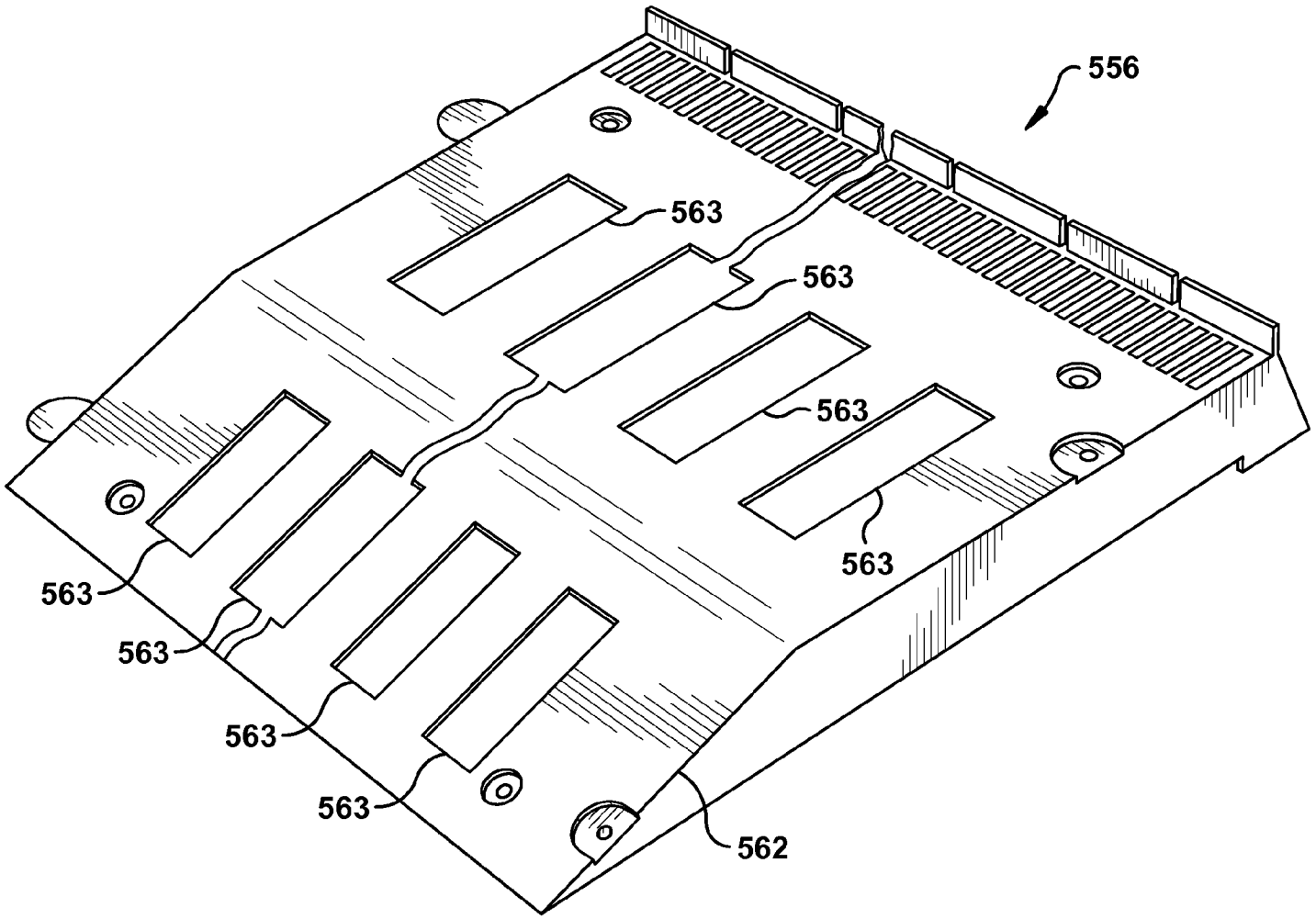
FIG. 10 is a partial perspective view of another embodiment of a roof deck intake vent.
Figure 11:
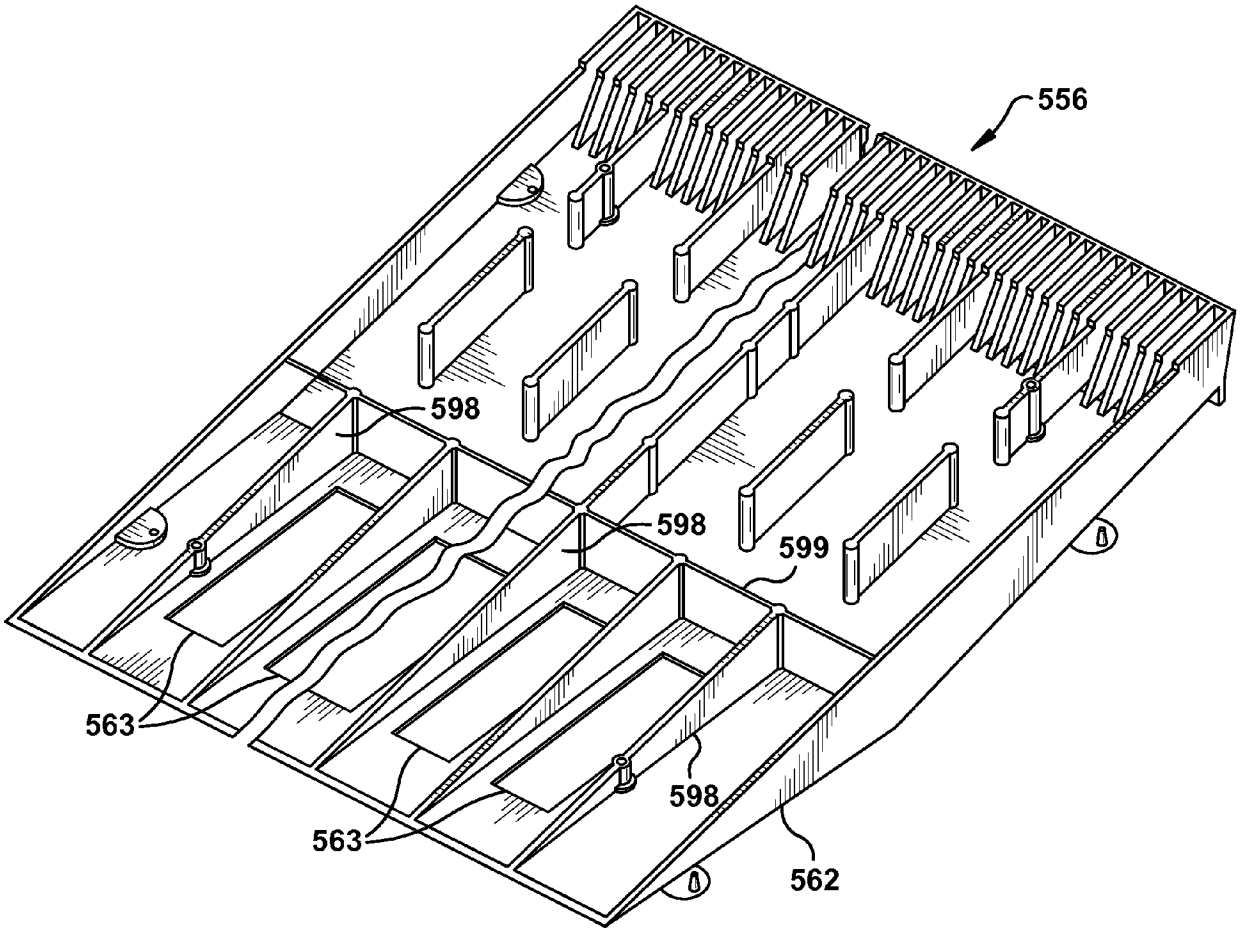
FIG. 11 is a partial perspective view of the bottom of the roof deck intake vent of FIG. 10.

Referring again to FIG. 2, the first portion 60 and second portion 62 of the intake vent 56 is shown as a continuous structure, that is, the first and second portions are void of gaps or openings other than the apertures 70*b*. Referring now to FIGS. 10 and 11, additional embodiments of an intake vent 556 are illustrated. In this embodiment, select areas 563 of the first portion 560 and/or the second portion 562 have been removed. By way of example only, in FIG. 10, selected areas are removed from both the first portion 560 and the second portion 562 and in FIG. 11, selected areas are removed from only the second portion 562. The select areas 563 are removed for several reasons. First, material savings can be realized: Second, the resulting intake vent 556 is lighter, thereby saving on shipping and handling costs. As shown in FIG. 11, the select areas 563 can be positioned between upper edge baffles 598, although such is not necessary.

As further shown in FIG. 11, optionally a cross-baffle 599 can be positioned at the inward ends of the upper edge baffles 598. The cross-baffle 599 is configured to provide addition support to the second portion 562 of the intake vent 556. However, it should be appreciated that the cross-baffle 599 in optional and the intake vent 556 can be practiced without the cross-baffle 599.

Referring again to the embodiment shown in FIG. 1, one example of a building sidewall 10 is illustrated. In this embodiment, the sidewall 10 does not include a soffit. The term "soffit", as used herein, is defined to mean an exposed undersurface of an exterior overhanging section of a roof deck. Referring now to the embodiment shown in FIG. 12, a sidewall 610, including a soffit 653, is illustrated.

The sidewall 610 includes top plates 616*a* and 616*b*, studs 618 and exterior sheathing 620. In the illustrated embodiment, the top plates 616*a* and 616*b*, studs 618 and exterior sheathing 620 are the same as, or similar to, the top plates 16*a* and 16*b*, studs 18 and exterior sheathing 20 shown in FIG. 1 and discussed above. However, in other embodiments, the top plates 616*a* and 616*b*, studs 618 and exterior sheathing 620 can be different from the top plates 16*a* and 16*b*, studs 18 and exterior sheathing 20.

Referring again to FIG. 12, the building includes a ceiling wall 626 attached to the sidewall 610, an insulation layer 644 positioned above the ceiling 626 and a roof deck 638 positioned above the insulation layer 644. In the illustrated embodiment, the ceiling 626, the insulation layer 644 and the roof deck 638 are the same as, or similar to, the ceiling 26, the insulation layer 44 and the roof deck 38 shown in FIG. 1 and discussed above. However, in other embodiments, the ceiling 626, the insulation layer 644 and the roof deck 638 can be different from the ceiling 26, the insulation layer 44 and the roof deck 38.

Referring again to FIG. 12, the roof deck 638 includes eaves 649 extending beyond the sidewall 610. The eaves 649 include an eaves interior space 651 and an undersurface, or soffit 653. In certain embodiments such as the embodiment illustrated in FIG. 12, the soffit 653 includes a soffit vent 655 configured to provide for flows of air to flow through the soffit vent 655 and flow freely up a plurality of rafters 636 and into an attic 642 as shown by direction arrows B600.

A fascia board 646 connects the soffit 653 with the roof deck 638. In the illustrated embodiment, the fascia board 646 is the same as, or similar to, the fascia board 46 illustrated in FIG. 1 and described above. However, the fascia board 646 can be different from the fascia board 46.

Referring again to FIG. 12, a slot 608 is formed in the roof deck 638 and an intake vent 656 is positioned at the lower edge of the roof deck 38, between a first ice and water barrier layer 641 and a second ice and water barrier layer 668 as discussed above. In the manner, the intake vent 656 is configured as a conduit, to allow a flow of air external to the building to enter the roof deck 638 through the slot 608 and flow freely up the rafters 636 and into the attic 642, the flow of air through the intake vent 656 is shown by the direction arrows A600. In this manner, the intake vent 656 and the soffit vent 655 cooperate to provide sufficient intake ventilation to the attic 642.

Figure 12:
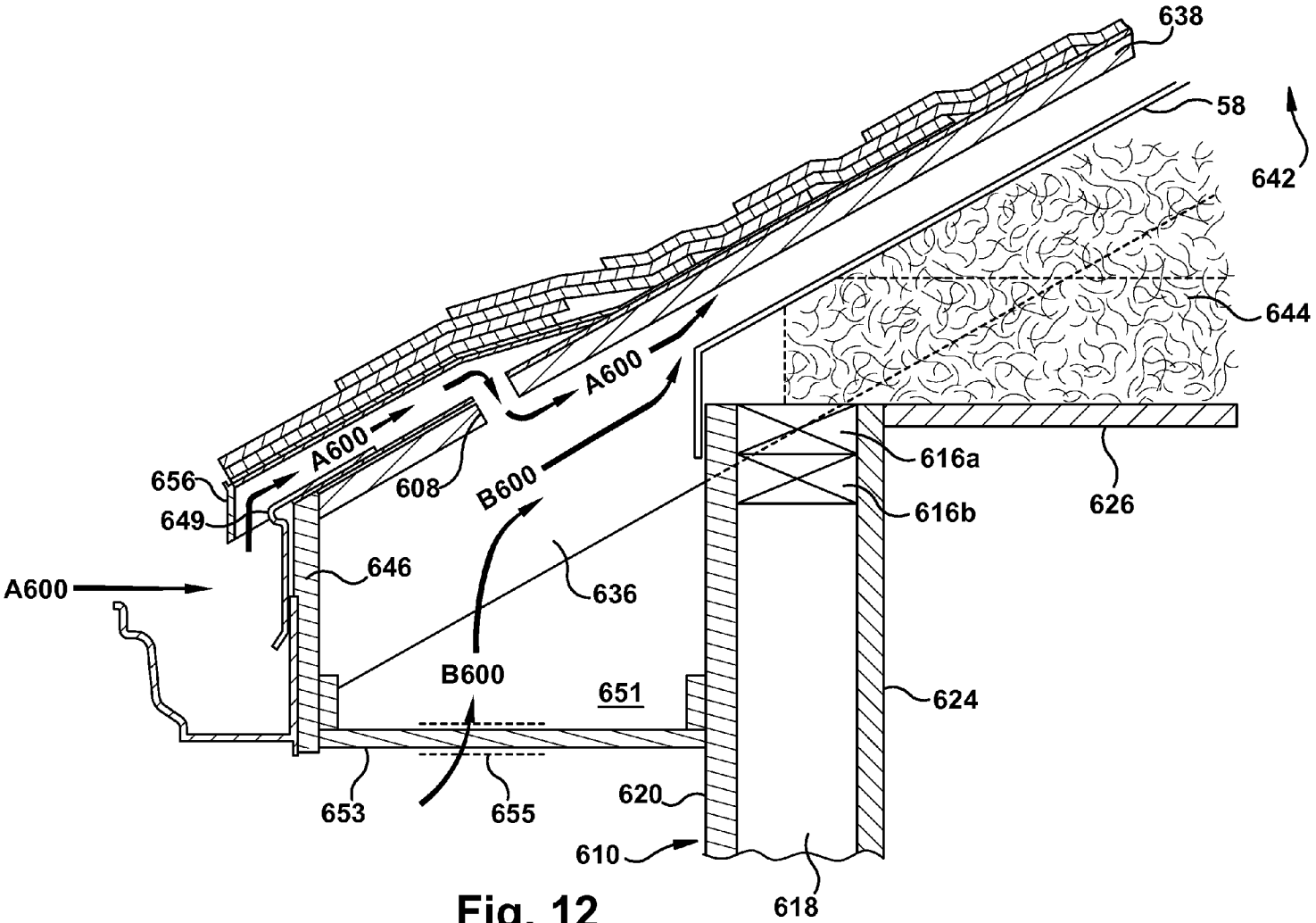
FIG. 12 is a side view, in elevation, of a portion of a building structure incorporating another embodiment of a roof deck intake vent.
Figure 13:
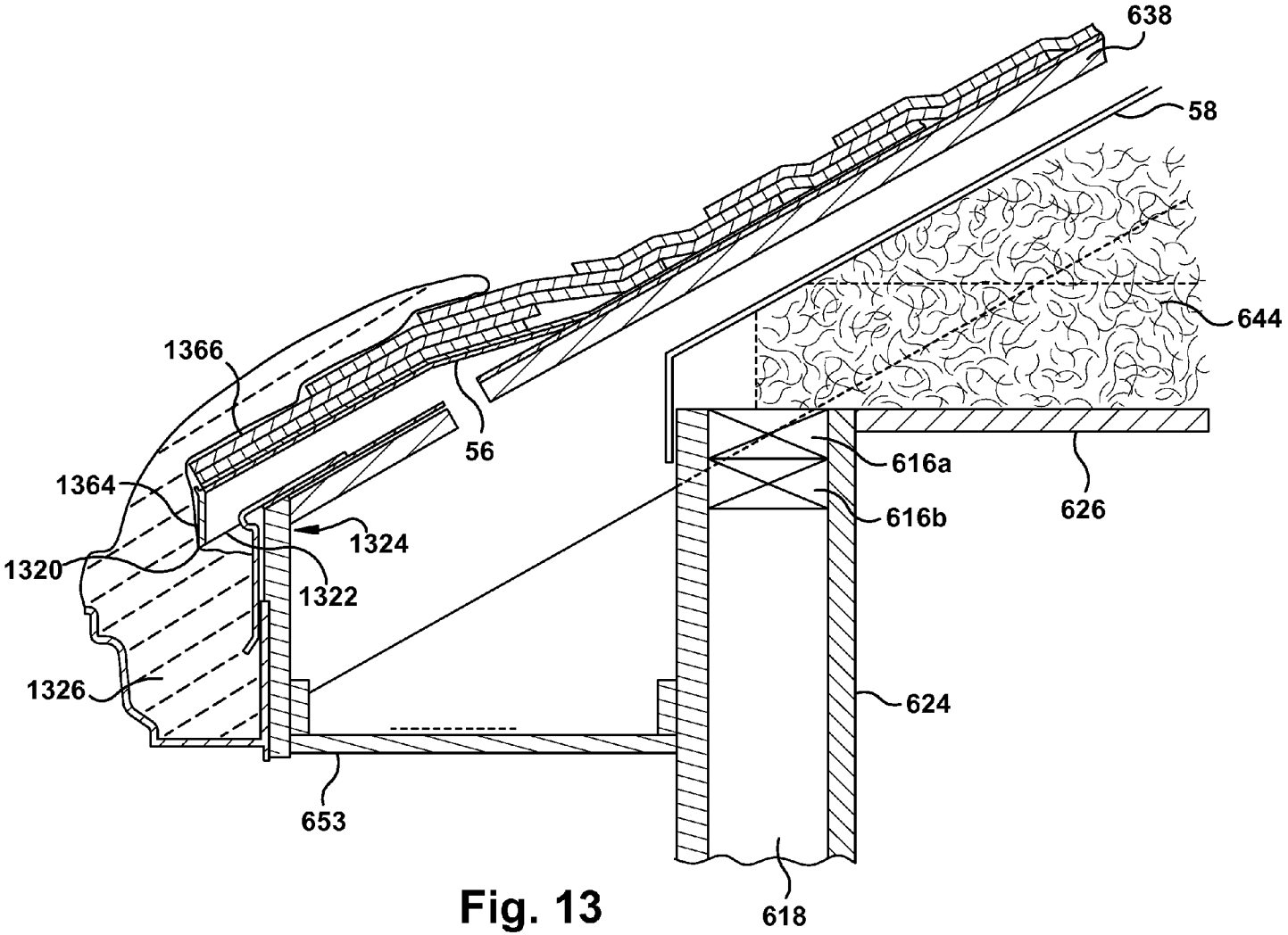
FIG. 13 illustrates the building structure and roof deck intake vent shown in FIG. 12, with ice building up in a gutter.

FIG. 13 illustrates the roof construction illustrated by FIG. 12, with ice built up in the gutter and onto the roof. The vent shown in FIG. 13 can be in accordance with any of the embodiments disclosed herein. Referring to FIG. 13, in one exemplary embodiment the vent 56 is configured to prevent ice in the gutter from building up and into the vent 56. In the illustrated exemplary embodiment, a lower front edge 1320 is below the remainder 1322 of the vent intake when the vent is installed on the edge 1324 of the roof. Water freezes and forms a seal against this lower edge 1320. As a result, ice 1326 forms up to the level of the lower front edge 1320, then up the exterior face 1364 of the vent 56, and over the shingle surface 1366. The seal between the ice and the lower front edge 132 ice 1326 intrusion into the vent.

The principles and mode of operation of the deck top roof intake vent have been described in its preferred embodiments. However, it should be noted that the deck top roof intake vent may be practiced otherwise than as specifically illustrated and described without departing from its scope.

What is claimed is:

1. A roof deck intake vent comprising:

a first top wall connected to a second top wall, the first top wall extending from a lower edge to the second top wall, and the second top wall extending from the first top wall to an upper edge;

opposing first and second side walls connected to the first and second top walls, the opposing first and second side walls extending from the upper edge to the lower edge, and from the first and second top walls, the first and second walls each including a main portion extending from the upper edge to an extension portion, the extension portion extending from the main portion to the lower edge;

wherein at least a portion of each extension portion extends below a bottom edge of each main portion when the bottom edge is oriented horizontally.

2. The roof deck intake vent of claim 1, wherein in an installed position on a roof deck, the extension portions are positioned such as to prevent wind driven rain from entering the roof deck intake vent.

3. The roof deck intake vent of claim 1, wherein the second top wall forms an angle with the bottom edge of the main portion of the first side wall ranging from about 5° to about 30°.

4. The roof deck intake vent of claim 1, wherein the first top wall has a length ranging from about 4.0 inches to about 9.0 inches and the second top wall has a length ranging from about 3.0 inches to about 14.0 inches.

5. The roof deck intake vent of claim 1, wherein a spoiler extends from the first top wall.

6. The roof deck intake vent of claim 5, wherein the spoiler is configured to assist in the flow of air over shingles installed on top of the roof deck intake vent to thereby reduce uplift forces that act on the shingles due to wind.

7. The roof deck intake vent of claim 1, wherein the first and second top walls have top surfaces that are textured.

8. The roof deck intake vent of claim 1, wherein the first top wall includes a plurality of louvers.

9. The roof deck intake vent of claim 8, wherein the louvers are covered by shingles when the roof deck intake vent is in an installed position.

10. The roof deck intake vent of claim 1, wherein the first top wall forms an angle with the lower edge ranging from about 115° to about 130°.

11. The roof deck intake vent of claim 10, wherein the lower edge is substantially vertical when the roof deck intake vent is in an installed position.

12. The roof deck intake vent of claim 1, further comprising lower edge baffles, intermediate baffles, and nailing baffles.

13. The roof deck intake vent of claim 1, wherein bottom edges of the extension portions are substantially parallel to the first top wall.

14. The roof deck intake vent of claim 1, wherein an air intake is formed by the extension portions of the first and second side walls and the lower edge, the air intake having an unobstructed area ranging from about 7.0 square inches per lineal foot to about 20.0 square inches per lineal foot.

15. The roof deck intake vent of claim 5, wherein the spoiler forms an angle with the lower edge ranging from about 120° to about 160°.

16. The roof deck intake vent of claim 1, wherein at least a portion of the lower edge extends below a plane defined by an outer surface of a roof deck when the roof deck intake vent is in an installed position.

17. The roof deck intake vent of claim 1, wherein an air intake is spaced apart from the first top wall by the lower edge.

18. The roof deck intake vent of claim 1, wherein the lower edge is configured as a barrier to the flow of air into the roof deck intake vent.

19. The roof deck intake vent of claim 1, wherein a bottom of the roof deck intake vent is completely open.

20. The roof deck intake vent of claim 19, wherein an air intake is formed by projections that extend downward from the first top wall of the roof deck intake vent.

21. The roof deck intake vent of claim 1, wherein the first top wall is connected to the second top wall by an intermediate top wall.

22. The roof deck intake vent of claim 1, wherein the first top wall is connected to the second top wall by an intermediate top wall, and lengths of the first top wall and the intermediate top wall correspond to an exposed portion of an overlying shingle.

23. The roof deck intake vent of claim 1, wherein the first top wall is connected to the second top wall by an intermediate top wall, and lengths of the first top wall and the intermediate top wall correspond to a tab portion of an overlying shingle.

24. The roof deck intake vent of claim 1, further comprising a shiplap projection and a shiplap recess that allow two adjacent roof deck intakes to be installed in a shiplapped configuration.

25. The roof deck intake vent of claim 1, further comprising a top air intake formed in the top wall of the roof deck intake vent.

26. The roof deck intake vent of claim 25, wherein the top air intake includes a mesh.

27. The roof deck intake vent of claim 1, wherein a front edge of the lower edge is lower than a remainder of the roof deck intake vent when the roof deck intake vent is installed on an edge of a roof.

28. The rook deck intake vent of claim 1, wherein the roof deck intake vent is positioned on a roof deck that extends to an eave, wherein the lower edge of the roof deck intake vent is spaced apart a distance from the eave.

29. A roof comprising:

an eave;

a roof deck extending to the eave;

a plurality of shingles arranged on the roof deck; and a roof deck intake vent disposed on the roof deck, the roof deck intake vent comprising:

a first top wall connected to a second top wall, the first top wall extending from a lower edge to the second top wall, and the second top wall extending from the first top wall to an upper edge;

opposing first and second side walls connected to the first and second top walls, the opposing first and second side walls extending from the upper edge to the lower edge, and from the first and second top walls, the first and second walls each including a main portion extending from the upper edge to an extension portion, the extension portion extending from the main portion to the lower edge;

wherein at least a portion of each extension portion extends below a bottom edge of the main portion when the bottom edge is oriented horizontally;

wherein the extension portions are disposed beyond the eave of the roof and extending below a plane defined by an outer surface of the roof deck.

30. A roof comprising:

an eave;

a roof deck extending to the eave;

a plurality of shingles arranged on the roof deck; and a roof deck intake vent disposed on the roof deck, the roof deck intake vent comprising:

a first top wall connected to a second top wall, the first top wall extending from a lower edge to the second top wall, and the second top wall extending from the first top wall to the upper edge;

opposing first and second side walls connected to the first and second top walls, the opposing first and second side walls extending from the upper edge to the lower edge, and from the first and second top walls, the first and second walls each including a main portion extending from the upper edge to an extension portion, the extension portion extending from the main portion to the lower edge;

wherein at least a portion of each extension portion extends below a bottom edge of the main portion; when the bottom edge is oriented horizontally;

wherein the extension portions are disposed on the roof deck; and wherein the extension portions are configured to form a gap between the roof deck and the lower edge.

* * * * *